US011020756B2

(12) United States Patent
Sesser et al.

(10) Patent No.: US 11,020,756 B2
(45) Date of Patent: Jun. 1, 2021

(54) ORBITAL SPRINKLER WITH SPEED CONTROL BRAKE

(71) Applicant: Nelson Irrigation Corporation, Walla Walla, WA (US)

(72) Inventors: George L. Sesser, Walla Walla, WA (US); Craig B. Nelson, Walla Walla, WA (US); Andrew B. Hellie, College Place, WA (US); Steven E. Crawford, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 221 days.

(21) Appl. No.: 16/038,351

(22) Filed: Jul. 18, 2018

(65) Prior Publication Data

US 2018/0318852 A1 Nov. 8, 2018

Related U.S. Application Data

(63) Continuation-in-part of application No. 15/161,920, filed on May 23, 2016, now Pat. No. 10,239,066.

(51) Int. Cl.
*B05B 3/00* (2006.01)
*B05B 3/04* (2006.01)
(Continued)

(52) U.S. Cl.
CPC ..... *B05B 3/008* (2013.01); *B05B 3/005* (2013.01); *B05B 3/0486* (2013.01); *B05B 1/323* (2013.01); *B05B 15/74* (2018.02)

(58) Field of Classification Search
CPC ..... B05B 3/008; B05B 3/0463; B05B 3/005; B05B 3/0486; B05B 15/74; B05B 1/323; F16H 1/145; F16H 55/0806; B23F 9/02
See application file for complete search history.

(56) References Cited

U.S. PATENT DOCUMENTS 3,648,928 A 3/1972 Lindgren
4,795,100 A 1/1989 Purtell et al.
(Continued)

FOREIGN PATENT DOCUMENTS

WO WO 2010/019850 2/2010
WO WO 2015/061849 5/2015
WO WO 2018/089462 5/2018

OTHER PUBLICATIONS

Extended European Search Report dated Jun. 9, 2020 issued in European Patent Application No. 20158329.1, 5 pp.
(Continued)

*Primary Examiner* — Tuongminh N Pham
(74) *Attorney, Agent, or Firm* — Nixon & Vanderhye P.C.

(57) ABSTRACT

A spool and wobbler assembly for a sprinkler includes a spool section with facing spool flanges on opposite sides of a spool core, where at least one of the spool flanges includes a circumferential rolling ledge. A wobbler cage including a wobbler ring is supported on the spool section, and a water deflector plate is coupled with the wobbler cage. An underside of the wobbler ring is provided with a circumferential rolling surface that engages the circumferential rolling ledge of the at least one spool flange. The rolling surface and rolling ledge provide for smoother orbital motion of the deflector plate.

11 Claims, 48 Drawing Sheets

(51) Int. Cl.
*B05B 1/32* (2006.01)
*B05B 15/74* (2018.01)

(56) References Cited

U.S. PATENT DOCUMENTS 5,279,675 A * 1/1994 Verbeek ..... B05B 3/066 134/22.1
5,381,960 A 1/1995 Sullivan et al.
5,439,174 A 8/1995 Sweet
5,588,595 A 12/1996 Sweet et al.
5,671,885 A 9/1997 Davisson
5,950,927 A 9/1999 Elliott et al.
6,267,299 B1 7/2001 Meyer
6,341,733 B1 1/2002 Sweet
6,382,525 B1 5/2002 Santiesteban et al.
6,439,477 B1 8/2002 Sweet et al.
6,530,532 B1 3/2003 Santiesteban et al.
6,932,279 B2 8/2005 Burcham
7,070,122 B2 7/2006 Burcham et al.
7,287,710 B1 10/2007 Nelson et al.
7,395,977 B2 7/2008 Pinch et al.
7,562,833 B2 7/2009 Perkins et al.
7,770,821 B2 8/2010 Pinch
7,942,345 B2 5/2011 Sesser et al.
8,028,932 B2 10/2011 Sesser et al.
8,991,724 B2 3/2015 Sesser et al.
2006/0006254 A1 1/2006 Meyer
2006/0108445 A1 5/2006 Pinch et al.
2006/0249594 A1 11/2006 Pinch
2008/0017732 A1 1/2008 Perkins et al.
2013/0327846 A1 12/2013 Sesser et al.
2014/0312143 A1 10/2014 Duffin et al.
2017/0114864 A1 * 4/2017 Morselli ..... F16H 55/0806

OTHER PUBLICATIONS

Extended European Search Report dated Nov. 15, 2019 issued in European Patent Application No. 19175235.1, 8 pp.
European Search Report dated Sep. 13, 2017 issued in European Patent Application No. 17169968.9, 7 pp.

* cited by examiner wetted area

ORBITAL SPRINKLER WITH SPEED CONTROL BRAKE

CROSS-REFERENCES TO RELATED APPLICATIONS

This application is a continuation-in-part of U.S. patent application Ser. No. 15/161,920, filed May 23, 2016, pending, the entire contents of which are hereby incorporated by reference in this application.

STATEMENT REGARDING FEDERALLY SPONSORED RESEARCH OR DEVELOPMENT (NOT APPLICABLE)

BACKGROUND

The invention relates to sprinkler heads and, more particularly, to sprinkler heads that nutate, or wobble, while they rotate, to thereby minimize the "donut effect" prevalent with conventional rotating sprinkler heads.

Various nutating or wobbling sprinkler head designs have been proposed, examples of which are described in prior U.S. Pat. Nos. 5,381,960; 5,950,927; 6,530,532 and 6,932,279. Commonly owned U.S. Pat. Nos. 5,439,174; 5,588,595; 5,671,885; 6,267,299; 6,341,733; 6,439,477; 7,287,710; 7,395,977; 7,562,833; 7,942,345; 8,028,932 and 8,991,724 provide further examples of nutating or wobbling sprinkler heads. There are potential shortcomings, however, that can nullify the very nutating affect that makes such sprinklers attractive in the first instance.

One problem often encountered with sprinklers of this type relates to stalling at start-up or even during normal operation. Stalling occurs when the water distribution plate of the sprinkler head fails to tilt at start-up, or ceases tilting during operation, thereby simply rotating and distributing a stream particularly susceptible to the "donut effect" where the wetted pattern area is shaped like a solid ring around a dry center. When nutating or wobbling sprinklers operate as designed, the nutating action tends to fill in the pattern in a substantially uniform manner. Thus, it is important that the water distribution plate reliably and consistently remain in a tilted orientation on start-up and while rotating to achieve the desired wobbling or nutating action.

The stalling problem discussed above has been solved in different ways (see, for example, U.S. Pat. Nos. 5,381,960 and 6,341,733).

Another problem relates to the relatively high speed of rotation of the wobbling sprinkler head. High rotational speeds create the well-known but undesirable "horse-tail" effect that shortens the radius of throw of the sprinkler. While it has been shown that slowing the rotation of the sprinkler using a brake mechanism is effective to obtain maximum throw, completely satisfying solutions to the problem of slowing the rotation speed of a wobbling sprinkler head have yet to be developed. One attempt to slow a wobbling head is described in U.S. Pat. No. 7,395,977.

There remains a need for a wobbler-type sprinkler that effectively and reliably achieves maximum throw radius while maintaining the pattern-uniformity benefits of the wobbler-type sprinkler.

The embodiments shown in the noted U.S. Pat. No. 8,991,724 utilize a framework that surrounds the moving plate/cage. The framework is bulky and expensive. Additionally, such framework requires a larger diameter canister if the sprinkler head is to be mounted in a pop-up canister.

Moreover, the fixed strut portions of the framework create dry shadows in the water pattern. Still further, stringy material such as moss or food processing waste in the water can hairpin and build up on the struts and cause stalling issues.

In the sprinkler head of the noted parent application, a wobbler ring is provided with ridges that are engageable with a gear plate as the wobbler cage is rotated. The gear plate and ridges serve to maintain control and alignment of the wobbler cage during use. As the unit orbits, the meshing of these teeth prevent rotary slippage of the wobbler cage. With each orbit, the cage advances one tooth, thereby clocking the spokes of water coming off the deflector plate to fill in the water pattern. A minor drawback with this design is that as the ridges roll across the teeth of the gear plate, the wobbler cage is shifted up and down as it rolls between the flats of the ridges. This can create unwanted drool and inconsistency in the water pattern.

It would be desirable to overcome the drawbacks with existing designs.

BRIEF SUMMARY

The wobbling sprinkler head according to the described embodiments provides for the desired orbital action and braking without large fixed strut framework. Eliminating the framework enables the use of a smaller diameter canister if mounting in a pop-up canister is desired. Additionally, eliminating the framework avoids the dry shadows as well as the potential for stringy material in the water to hairpin and build up on the struts.

The described sprinkler head also lends itself to many different shapes of water patterns without extra cost or complexity. The sprinkler head can provide for full circle watering or, by removing teeth in selected locations of a fixed gear, the wobbler cage can orbit very quickly to some areas (in areas of unbraked orbital movement) leaving very little water in these areas. Still further, the action of the water deflector plate moving in and out of the nozzle stream creates emerging/receding streams that fill in the water pattern for good distribution uniformity without an external diffuser.

In some embodiments, the engagement between the ridges on the wobbler ring and the teeth of the gear plate is replaced with a smooth ledge to eliminate the up and down movement of the wobbler cage as the gear teeth roll across the wobbler ring ridges. The teeth in this embodiment resist torque and thereby prevent slipping without interfering with the orbital motion of the wobbler cage.

In an exemplary embodiment, a sprinkler head includes a sprinkler body with a spool section having facing spool flanges on opposite sides of a spool core, where at least one of the spool flanges includes a circumferential rolling ledge. A nozzle is positioned within the sprinkler body, and a wobbler cage including a wobbler ring is supported on the spool section. A water deflector plate coupled with the wobbler cage is disposed downstream of the nozzle. A brake assembly is coupled with the water deflector plate for slowing a rotating and wobbling motion of the wobbler cage and the water deflector plate. The brake assembly includes a shaft extending through the water deflector plate and a yoke arm disposed at an end of the shaft, where the yoke arm is engageable with the sprinkler body. An underside of the wobbler ring includes a circumferential rolling surface engaging the circumferential rolling ledge of the at least one spool flange.

The sprinkler head may also include spool teeth positioned on an outside circumference of the one of the spool flanges with the circumferential rolling ledge. The underside of the wobbler ring may include wobbler teeth positioned radially outward of the circumferential rolling surface. In the context, the wobbler teeth may be positionable in spaces defined between the spool teeth. The spool teeth may extend radially from the outside circumference of the one of the spool flanges including the circumferential rolling ledge. In some embodiments, the spool teeth may extend axially from the one of the spool flanges including the circumferential rolling ledge. In this context, the spool teeth may include a beveled edge. Additionally, leading edges of the spool teeth may be closer to vertical than trailing edges of the spool teeth. In one embodiment, the wobbler ring may be provided with an upwardly protruding lip around its perimeter.

In another exemplary embodiment, a sprinkler head includes a sprinkler body having a spool section with a top spool flange facing a bottom spool flange on opposite sides of a spool core. The bottom spool flange includes a circumferential rolling ledge. A wobbler cage includes a wobbler ring supported on the spool section, and a water deflector plate is coupled with the wobbler cage. A brake assembly is cooperable with the wobbler cage for slowing a rotating and wobbling motion of the wobbler cage and the water deflector plate. An underside of the wobbler ring includes a circumferential rolling surface engaging the circumferential rolling ledge of the bottom spool flange.

In yet another exemplary embodiment, a spool and wobbler assembly for a sprinkler includes a spool section with facing spool flanges on opposite sides of a spool core, at least one of the spool flanges including a circumferential rolling ledge; a wobbler cage including a wobbler ring supported on the spool section; and a water deflector plate coupled with the wobbler cage. An underside of the wobbler ring includes a circumferential rolling surface engaging the circumferential rolling ledge of the at least one spool flange.

BRIEF DESCRIPTION OF THE DRAWINGS

These and other aspects and advantages will be described in detail with reference to the accompanying drawings, in which.

DETAILED DESCRIPTION

Figure 1:
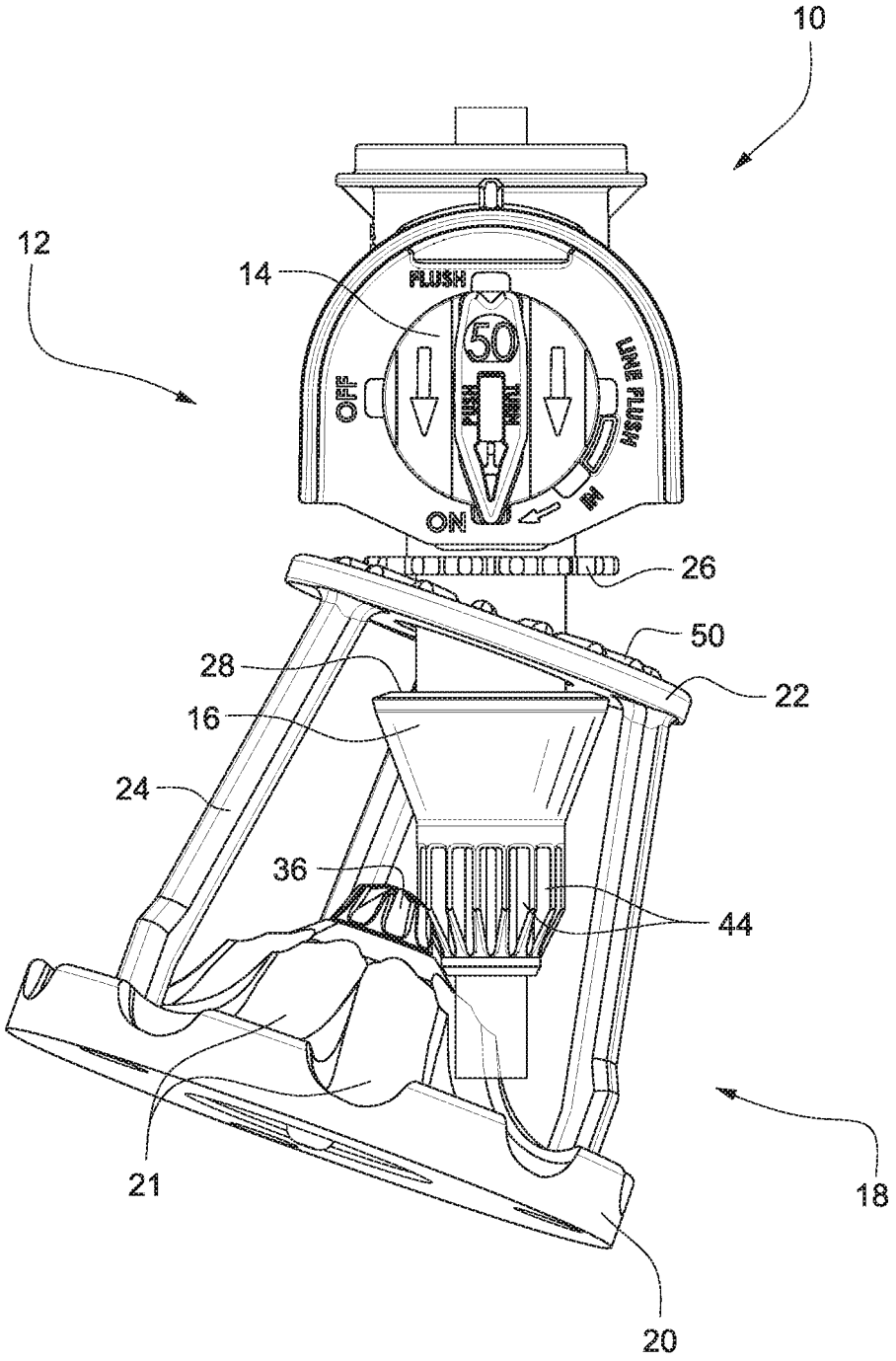
FIG. 1 shows a wobbler-type sprinkler head according to an exemplary embodiment.
Figure 2:
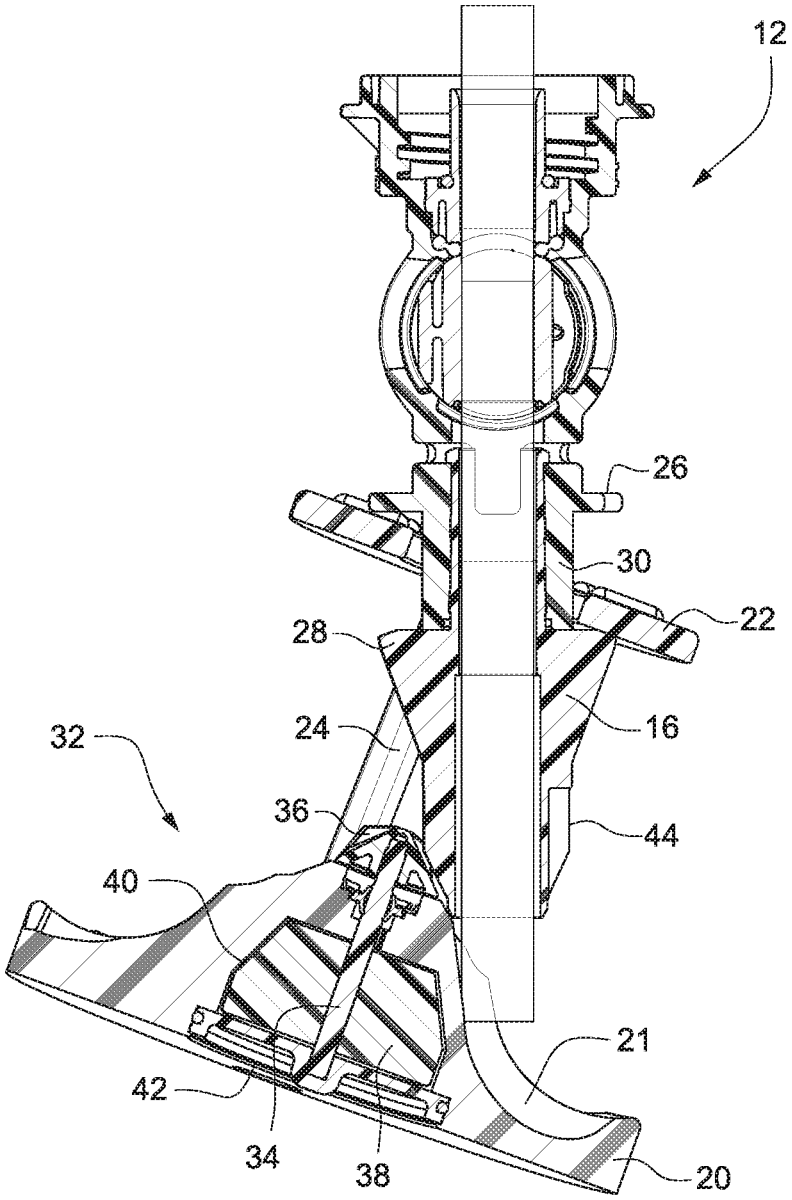
FIG. 2 is a cross-sectional view through the sprinkler head shown in FIG. 1.
Figure 3:
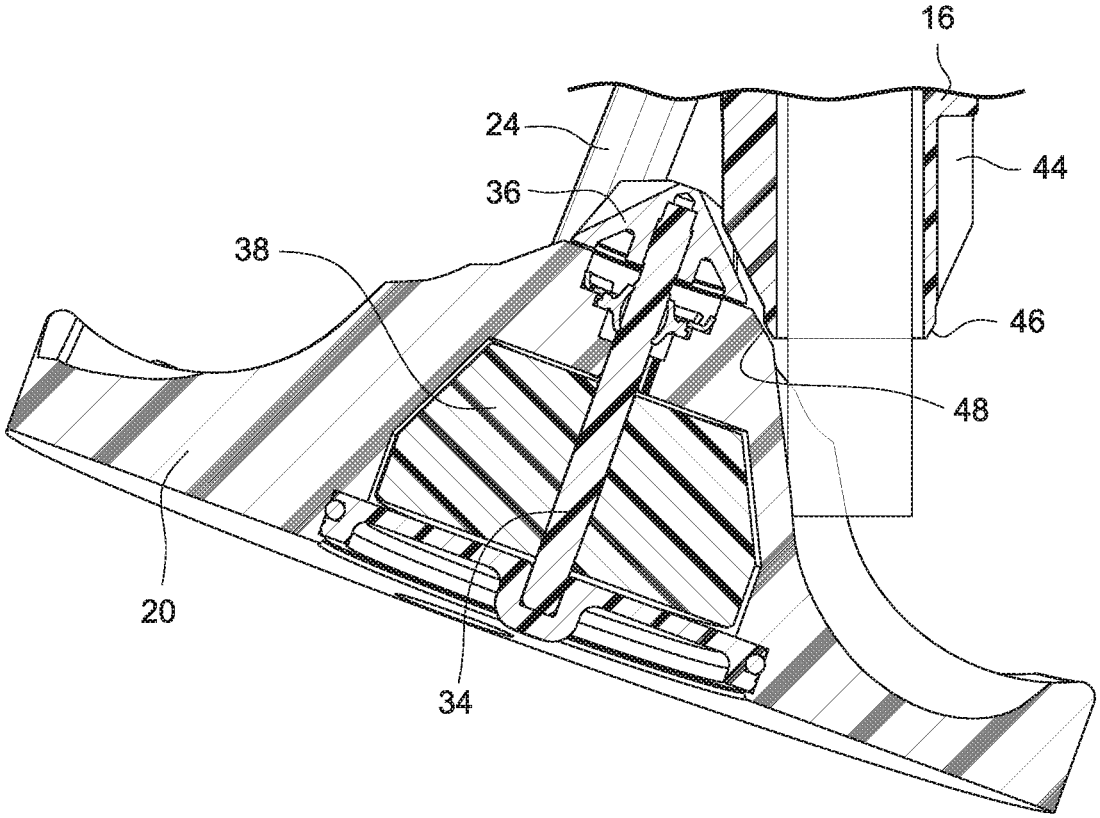
FIG. 3 is a close-up sectional view of the water deflector plate and brake assembly.
Figure 4:
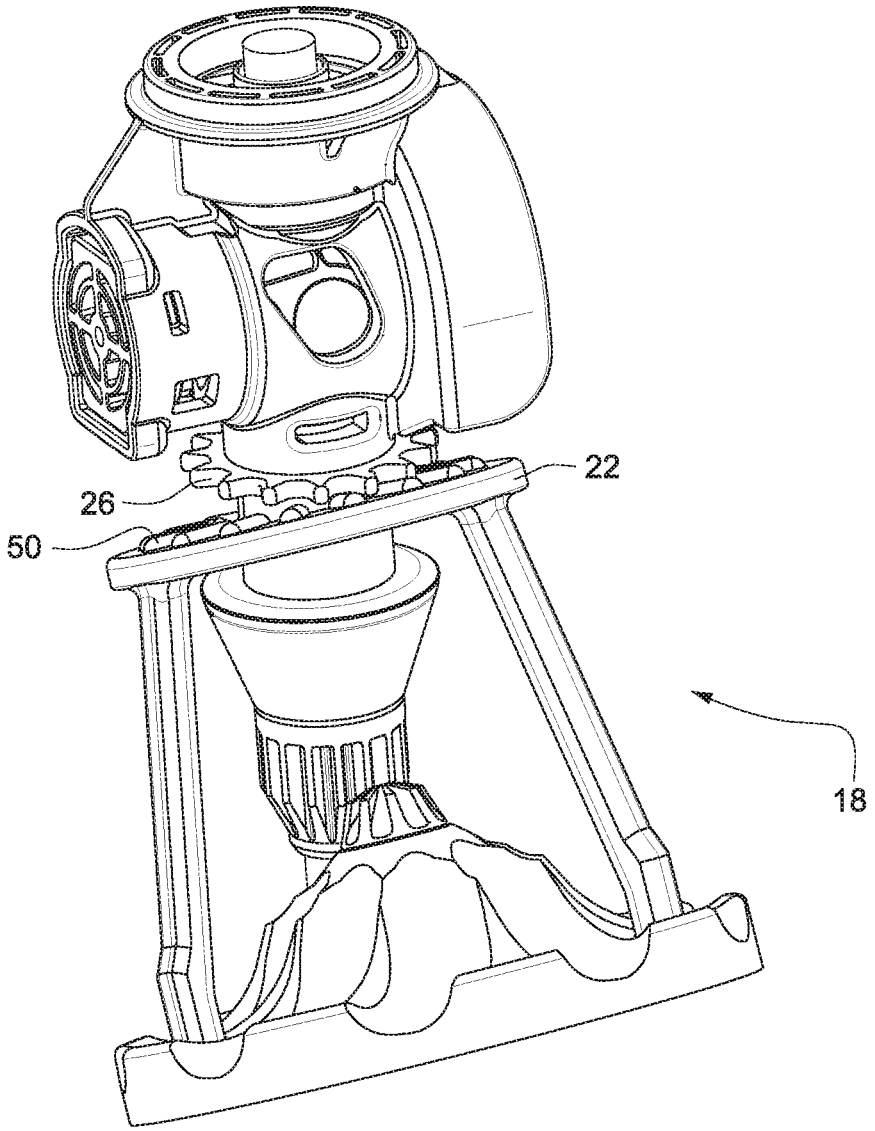
FIG. 4 is a perspective view of the sprinkler head shown in FIG. 1.

FIGS. 1-4 show a wobbler-type sprinkler head 10 according to an exemplary embodiment. The sprinkler head 10 includes a sprinkler body 12 and a nozzle 14 positioned within the sprinkler body 12. In some embodiments, the nozzle 14 is a nozzle insert that is positionable in a sideways-oriented, complementary recess provided in the sprinkler body 12. The nozzle/nozzle insert 14 may be formed as a substantially-cylindrical body, possibly injection-molded of hard plastic material such as PVC (or other suitable plastic or metal material). The nozzle 14 may be provided with a nozzle bore with an inlet in communication with water flow and an outlet or nozzle outlet orifice that nozzles or meters water output from the sprinkler body 12.

A fixed gear 16 is coupled with the sprinkler body 12, and a wobbler cage 18 is supported on the sprinkler body 12. A water deflector plate 20 is coupled with the wobbler cage 18 and disposed downstream of the nozzle 14. The water deflector plate 20 is positioned to intercept, i.e., deflect, the water flow output from the nozzle 14. The water deflector plate 20 includes a plurality of deflecting grooves 21 that deflect the water according to a predefined water pattern and also serve to impart a rotating moment on the deflector plate 20.

The wobbler cage 18 supports the water deflector plate 20 as shown. The wobbler cage 18 includes a wobbler ring 22 and a plurality of struts 24 connected to the wobbler ring 22. The water deflector plate 20 is connected to the wobbler cage 18 by the struts 24. The deflection grooves 21 of the water deflector plate 20 may be arranged relative to the struts 24 to minimize interference by the struts 24 during use. Regardless, since the wobbler cage 18 is turning during use, any interference by the struts 24 with the projected water flow is minimal and would not result in the shadow areas that are a problem with the existing strut framework of prior designs.

In the embodiment shown in FIGS. 1-4, the wobbler cage 18 is supported on the sprinkler body 12 by a gear plate 26 secured to the sprinkler body 12 and a shoulder 28 of the fixed gear 16. The wobbler cage 18 is positionable in the offset orientation shown in FIGS. 1-4 by virtue of the space between the gear plate 26 and the shoulder 28 and the size of an opening in the wobbler ring 22 over the sprinkler body 12. In some embodiments, with reference to FIG. 2, the gear plate 26 is integral with a sleeve member 30 secured below the nozzle housing. In some embodiments, with reference to FIG. 2, the fixed gear 16 is press and snap fitted into the sleeve member 30.

A brake assembly 32 is coupled with the water deflector plate 20 for slowing a rotating and wobbling motion of the wobbler cage 18 and the water deflector plate 20. The brake assembly 32 may include a shaft 34 that extends through the water deflector plate 20 and a brake gear 36 disposed at an end of the shaft. The brake gear 36 is engageable with the fixed gear 16. In some embodiments, the brake assembly 32 is a viscous brake assembly including a rotor 38 that is press fit to the shaft 34 and is rotatable with the shaft 34. A bearing 42 supports the opposite end of the shaft 34. A high-viscosity damping fluid fills the cavity 40 and acts between the rotor 38 and the deflector plate 20. Braking action is imparted when the fluid is sheared as the rotor 38 rotates relative to the deflector plate 20.

In the embodiment shown in FIGS. 1-4, the fixed gear 16 includes external gear teeth 44, and corresponding teeth of the brake gear 36 are engaged with the external gear teeth 44 of the fixed gear 16. As discussed in more detail below, the external gear teeth 44 may be arranged according to a desired water pattern. In the exemplary embodiment shown in FIGS. 1-4, the brake gear 36 remains in engagement with the external gear teeth 44 of the fixed gear 16 regardless of whether water is flowing through the nozzle 14. As a consequence, the brake gear 36 is always positioned out of a water stream flowing through the nozzle 14.

In use, water flowing through the nozzle 14 impacts the grooves 21 on the water deflector plate 20, which disperses the water according to a predefined water pattern. The water flow impacting the grooves 21 on the water deflector plate 20 causes the water deflector plate and the wobbler cage 18 to rotate. The brake gear 36 engaged with the teeth 44 of the fixed gear 16 serves to control a rotating speed of the water deflector plate 20. In some embodiments, an exemplary normal speed of rotation may be in the range of 0.5-5 RPM. By removing gear teeth 44 in selected locations of the fixed gear 16, the deflector plate 20 can orbit very quickly through some areas. In areas of unbraked orbital movement, the deflector plate 20 may quickly accelerate to a speed of several hundred RPMs or more, leaving very little water in these areas. Exemplary gear teeth configurations for the fixed gear 16 and the resulting water pattern wetted areas are shown in FIGS. 12-23.

In the embodiment shown in FIGS. 1-4, since the brake gear 36 maintains its engagement with the fixed gear 16, the wobbler cage 18 and water deflector plate 20 are always tipped, eliminating the need for any other mechanism to get the deflector plate off-center at startup.

In some applications, the water deflector plate 20 may be subjected to side impact loads, e.g., being dragged through crops or the like. In order to prevent damage to the gear teeth 44 of the fixed gear 16 and/or the brake gear 36, the fixed gear 16 is provided with a snout 46 that extends below the gear 16, and the water deflector plate 20 is provided with a shoulder 48 that together take the load if the plate 20 gets struck from the side. See, e.g., FIG. 3. As such, the brake gear 36 and the shaft 34 can be protected from overload. Additionally, with particular reference to FIG. 4, the wobbler ring 22 may be provided with ridges 50 that are engageable with the gear plate 26 as the wobbler cage 18 is rotated. The gear plate 26 and ridges 50 maintain control and alignment of the wobbler cage 18 during use. In an exemplary construction, the gear plate 26 may have fifteen teeth, and there may be sixteen ridges 50 on the wobbler ring 22. As the unit orbits, the meshing of these teeth prevent rotary slippage of the wobbler cage 18; and also with each orbit, the cage advances one tooth, thereby clocking the spokes of water coming off the grooves 21 to fill in the water pattern.

Figure 5:
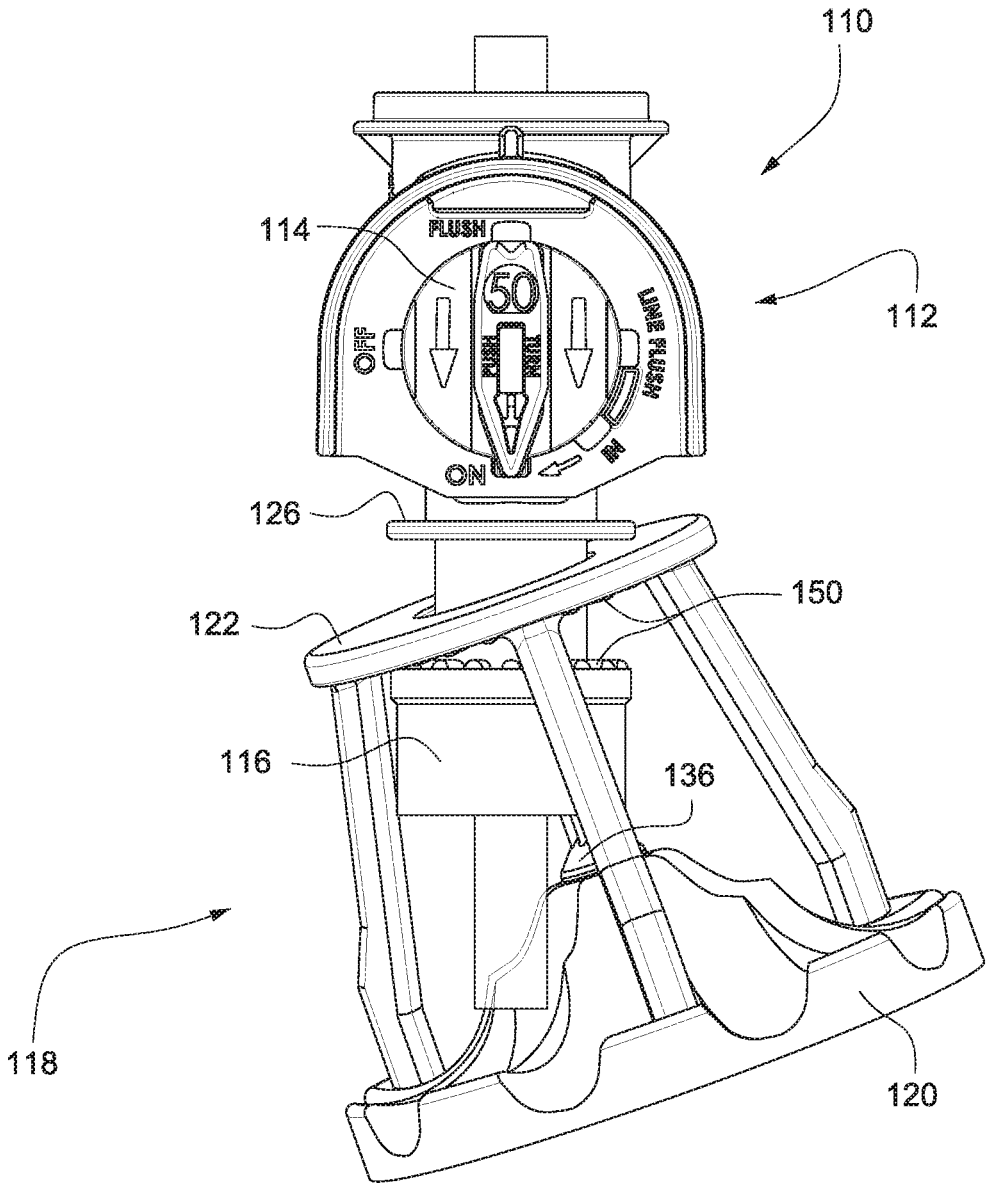
FIG. 5 shows a wobbler-type sprinkler head according to another exemplary embodiment.
Figure 6:
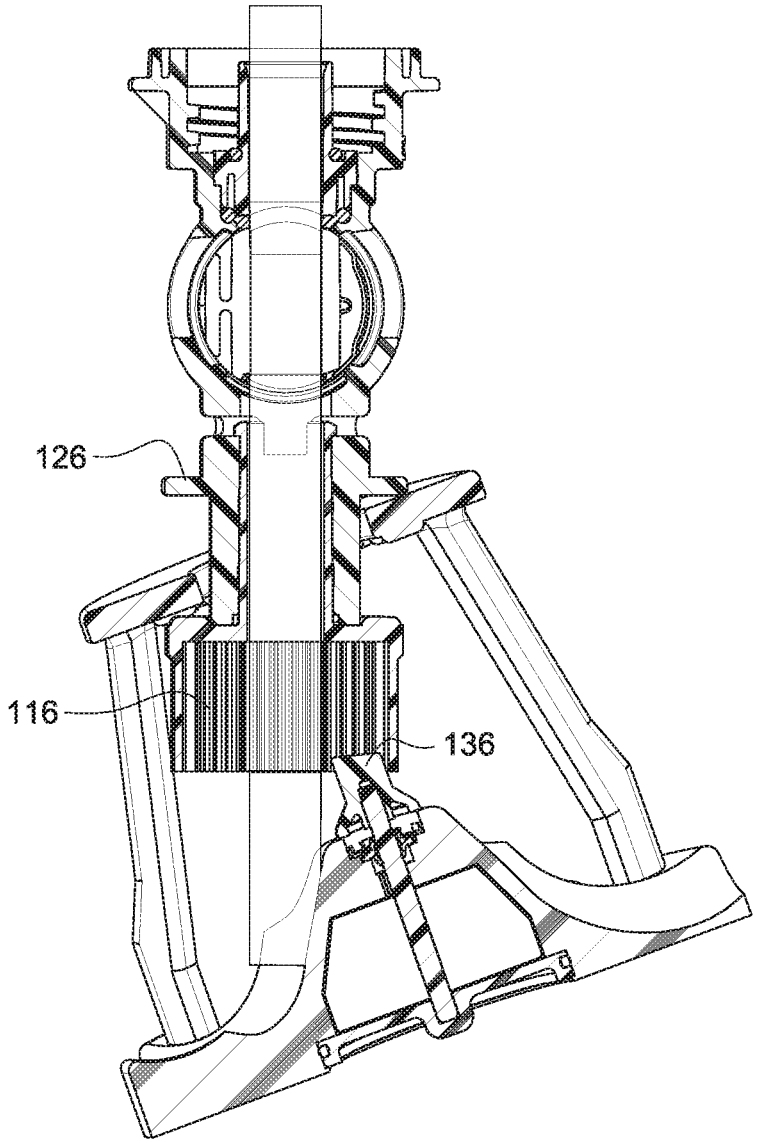
FIG. 6 is a cross-sectional view of the sprinkler head shown in FIG. 5.
Figure 7:
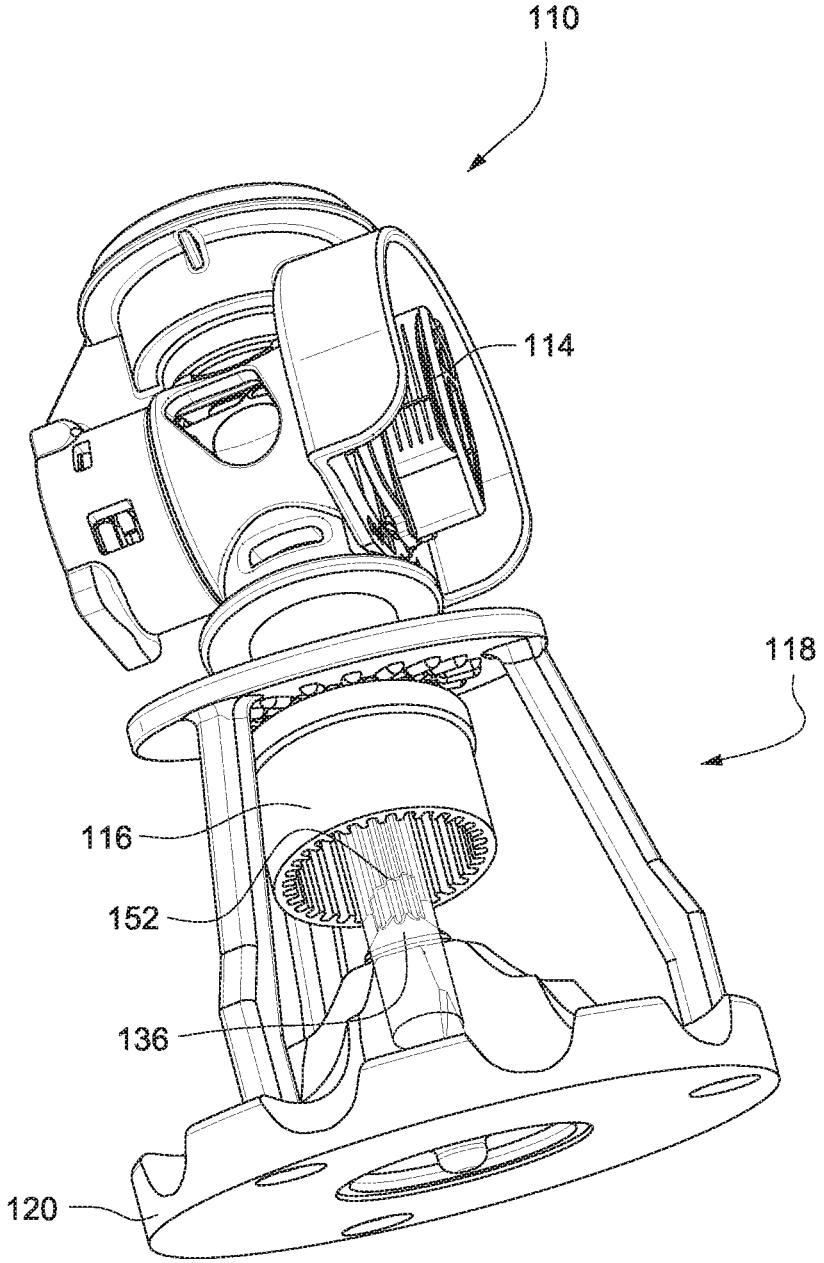
FIG. 7 is a perspective view of the sprinkler head shown in FIG. 5.

FIGS. 5-7 show an alternative embodiment of the wobbler-type sprinkler head according to the invention. In this and subsequent embodiments, similar elements are identified with like reference numerals preceded by a third digit.

The sprinkler head 110 in FIGS. 5-7 including a sprinkler body 112 utilizes a ring gear 116 with internal gear teeth as the fixed gear rather than the fixed gear 16 with external teeth shown in FIGS. 1-4. With the ring gear 116 and internal gear teeth, the wobbler cage 118 is positionable into an inactive position when no water is flowing through the nozzle 114 in which the wobbler cage 118 is generally level and the brake gear 136 is coaxial with an outlet of the nozzle 114 or the ring gear 116. In an active position as shown in FIGS. 5-7, the wobbler cage 118 is pivoted such that the brake gear 136 is engaged with the internal gear teeth of the fixed/ring gear 116.

In this embodiment, the gear plate 126 may be without spokes, and corresponding ridges 150 are provided on a deflector plate side of the wobbler ring 122 and an upstream surface of the ring gear 116. See FIGS. 5 and 7.

As shown in FIG. 7, a distal end 152 of the brake gear 136 may be angled relative to a flow of water through the nozzle 114. In some embodiments, at startup, in the inactive position, the wobbler cage will be hanging straight down. As water flows through the nozzle 114 and impacts the angled distal end 152 of the brake gear 136, the angle of the distal end 152 will force the deflector plate 120 and wobbler cage 118 off center. Once the wobbler cage 118 and deflector plate 120 are displaced, water flow through the nozzle 114 will maintain the offset orientation of the wobbler cage 118.

Gear teeth from the ring gear 116 may similarly be removed so that the deflector plate 120 can orbit very quickly through some areas to control the water pattern. Exemplary gear teeth configurations for the gear 116 and the resulting water pattern wetted areas are shown in FIGS. 24-29.

FIGS. 8-11 show another alternative construction for the wobbler-type sprinkler head 210 according to the invention. In this embodiment, the brake gear is replaced with a yoke arm 236 that is sized and positioned to loosely straddle a fixed sleeve 216. The wobbler cage 218 and water deflector plate 220 are pivotable between an inactive position (shown in FIGS. 10 and 11) and an active position (shown in FIGS. 8 and 9). The wobbler ring 222 of the wobbler cage 218 is positioned between the gear plate 226 and the shoulder 228 of the fixed sleeve 216.

In use, a water stream from the nozzle 214 impacts an angled surface 252 of the yoke arm 236 to force the wobbler cage 218 to an offset position toward the active position. Subsequently, the water flow impacting the water deflector plate 220 maintains the wobbler cage 218 and the deflector plate 220 in the active position. The yoke arm 236 is fixed to the shaft 234 of the brake assembly 232.

Figure 8:
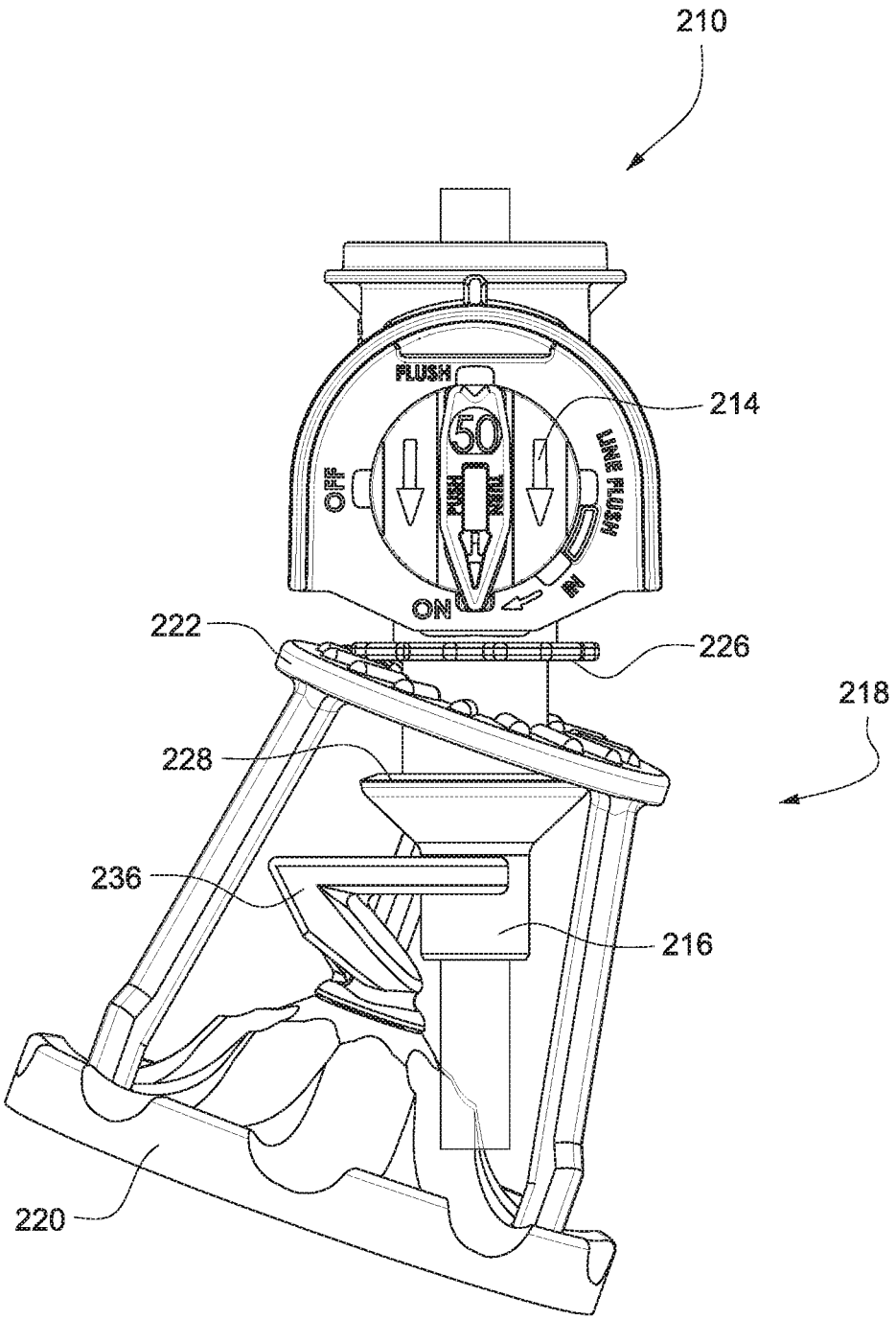
FIG. 8 shows a wobbler-type sprinkler head according to another exemplary embodiment.
Figure 9:
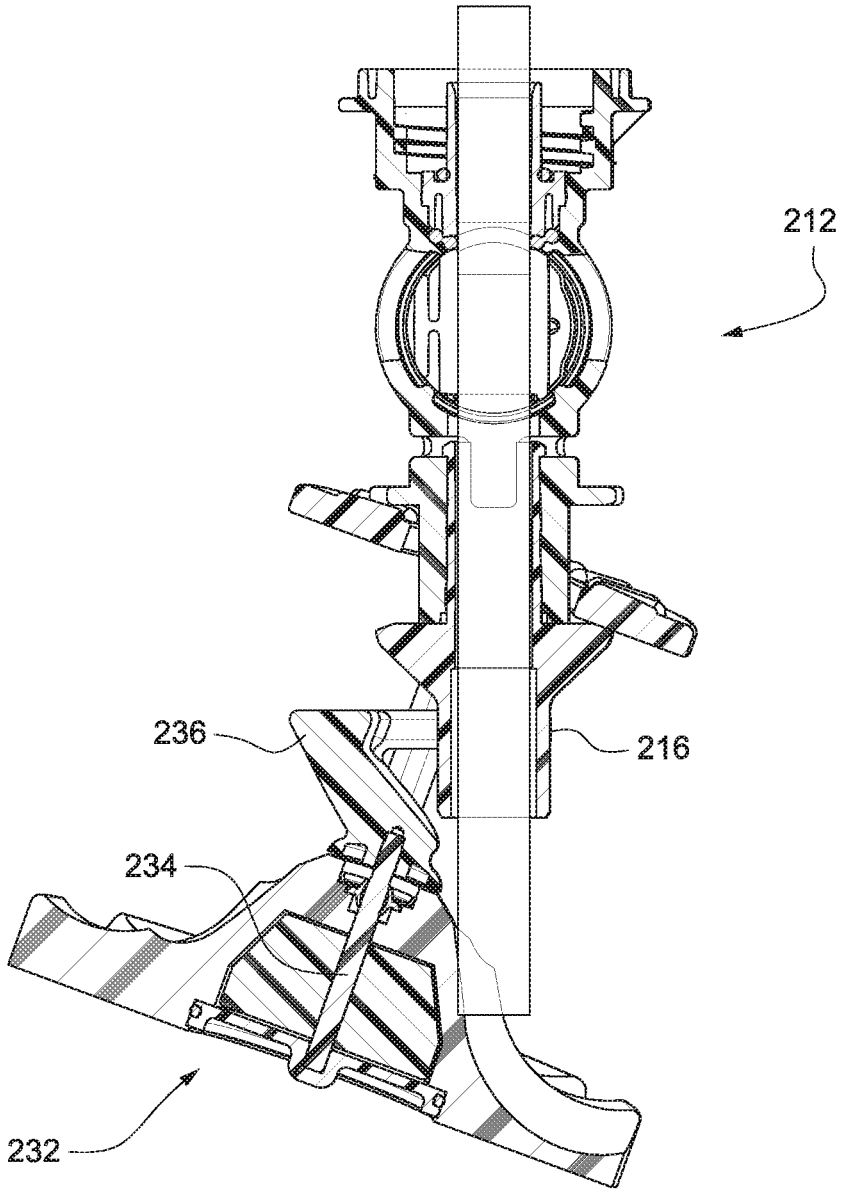
FIG. 9 is a cross-sectional view of the sprinkler head shown in FIG. 8.
Figure 10:
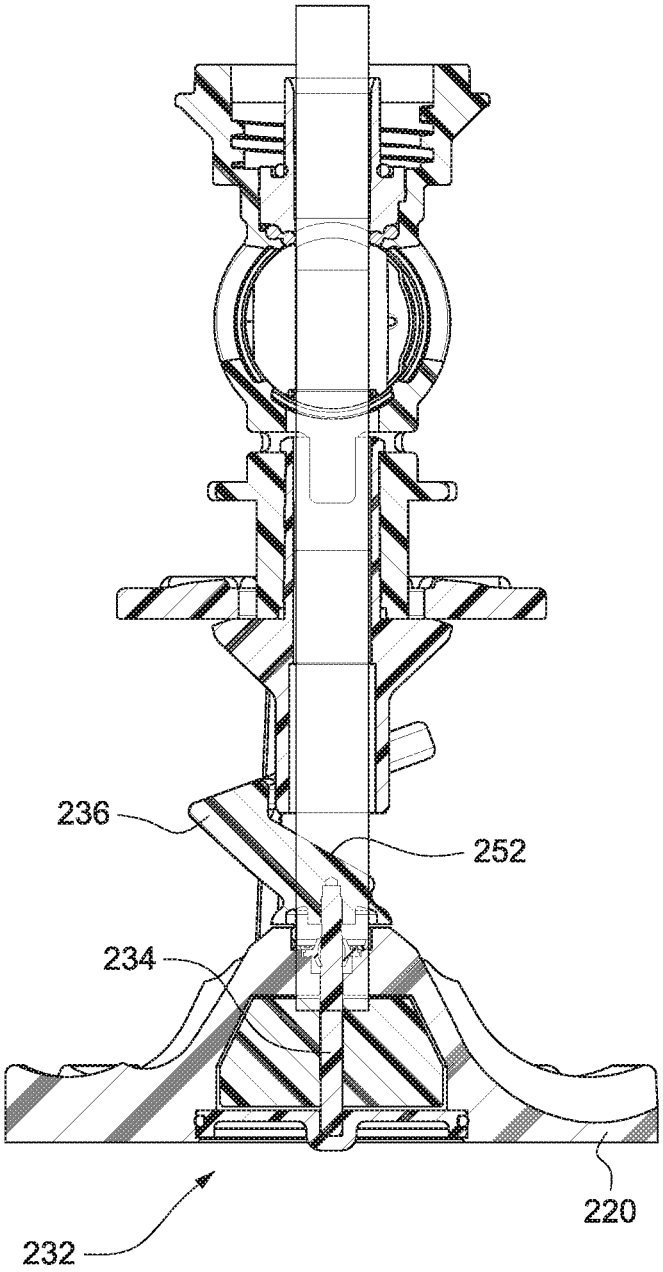
FIG. 10 is a cross-sectional view of the sprinkler head shown in FIG. 8 with the water deflector plate in an inactive position.
Figure 11:
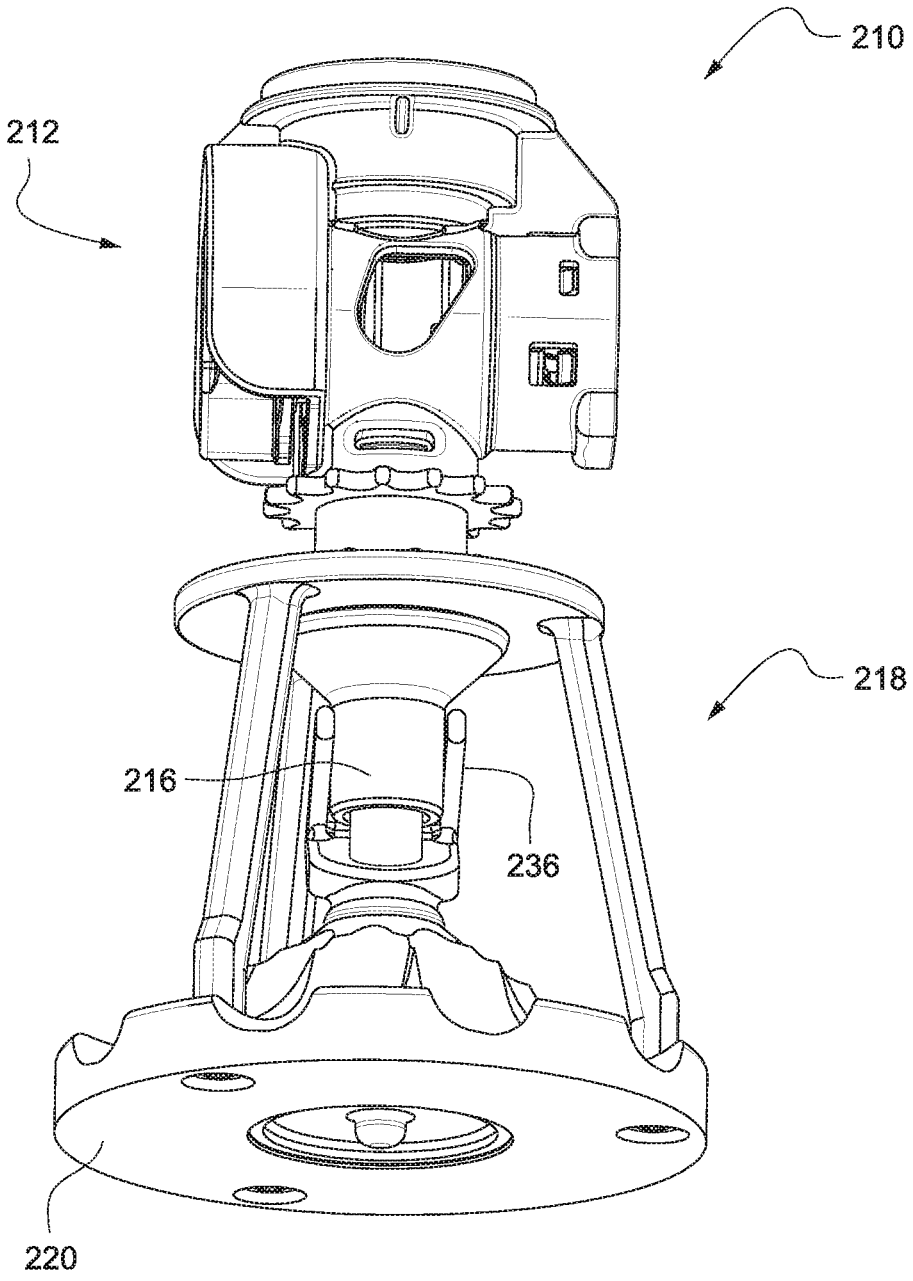
FIG. 11 is a perspective view of the sprinkler head shown in FIG. 10.
Figure 12:
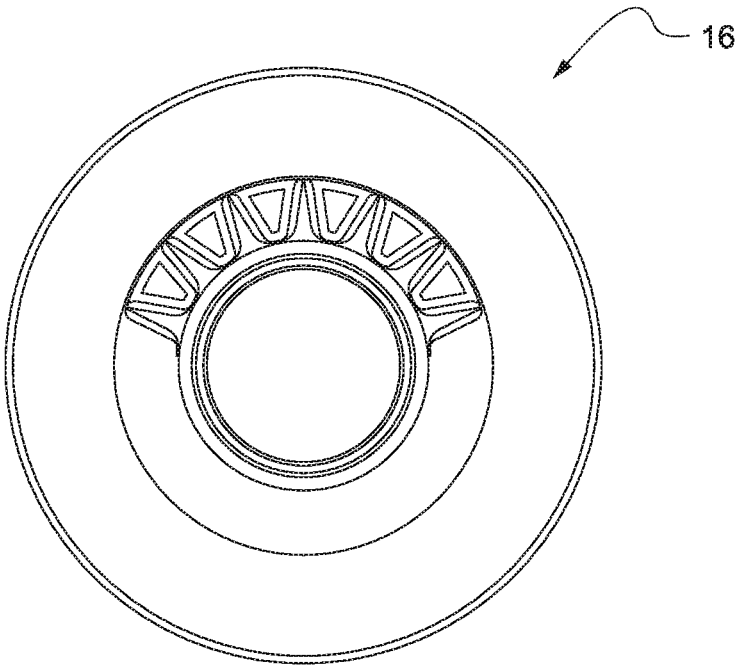
FIGS. 12-29 show exemplary gear configurations to effect different water patterns.
Figure 13:
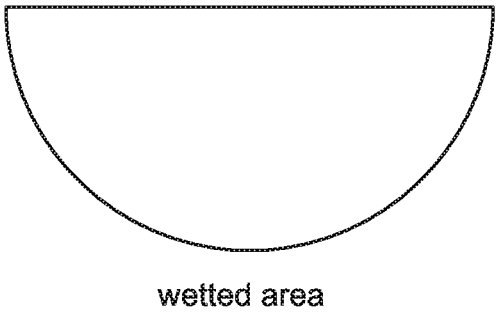
Figure 14:
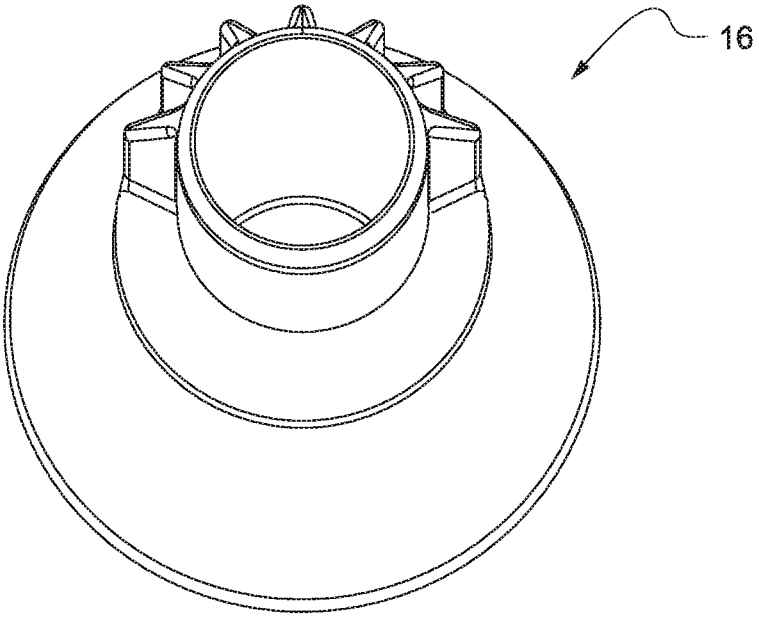
Figure 15:
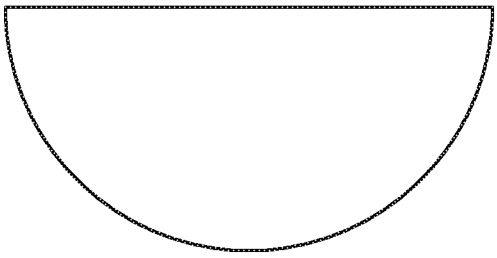
Figure 16:
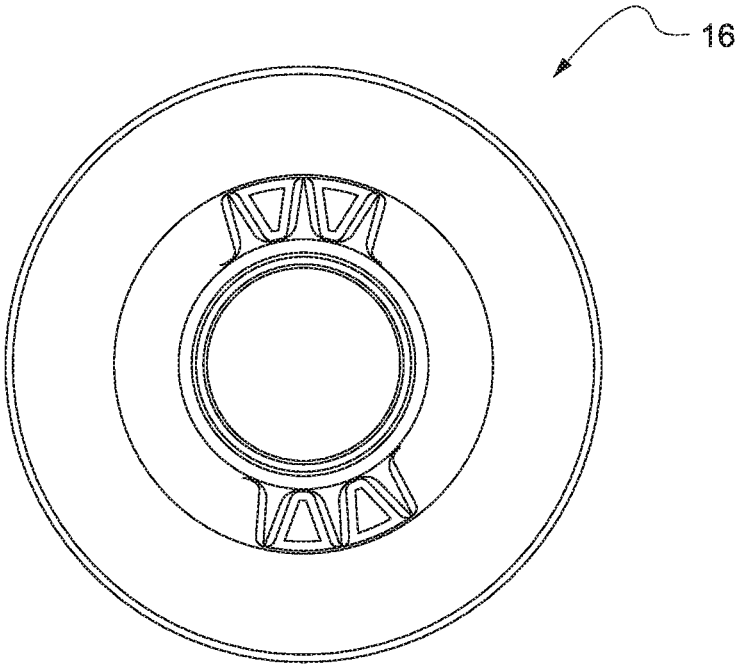
Figure 17:
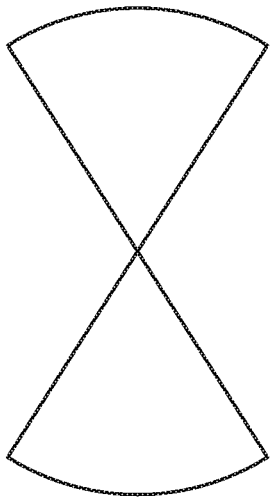
Figure 18:
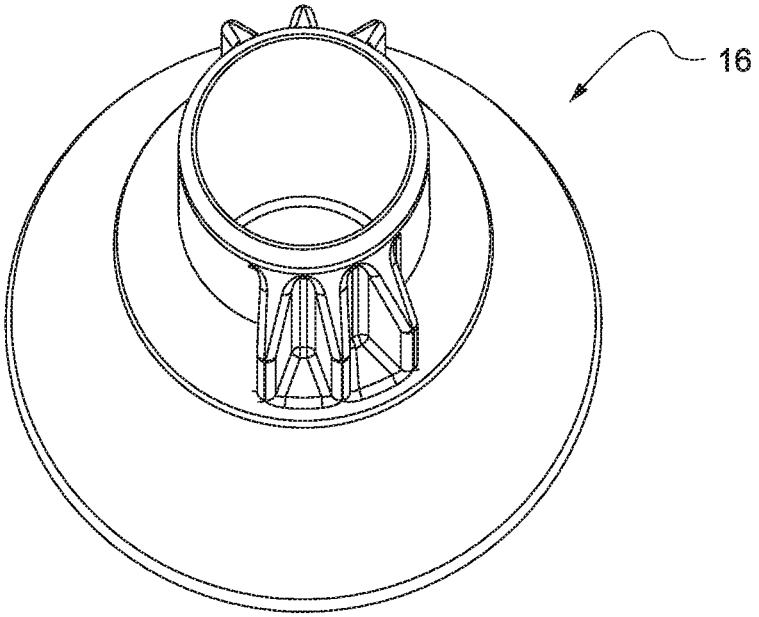
Figure 19:
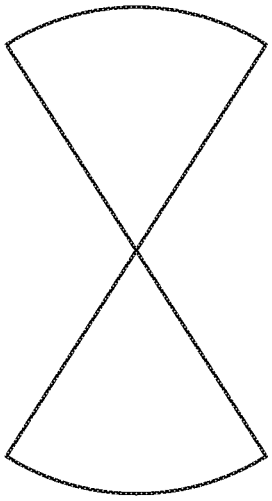
Figure 20:
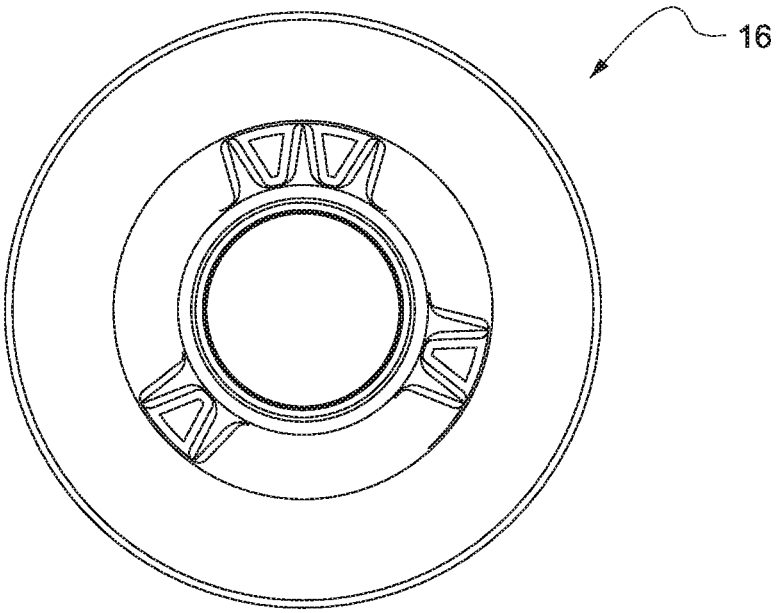
Figure 21:
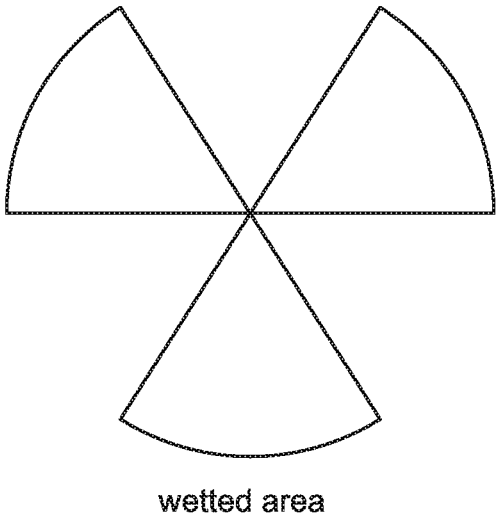
Figure 22:
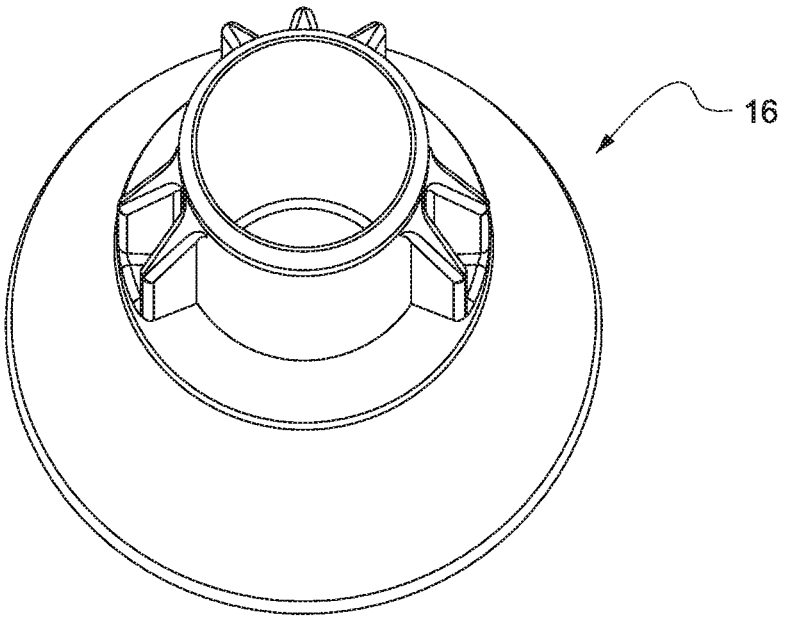
Figure 23:
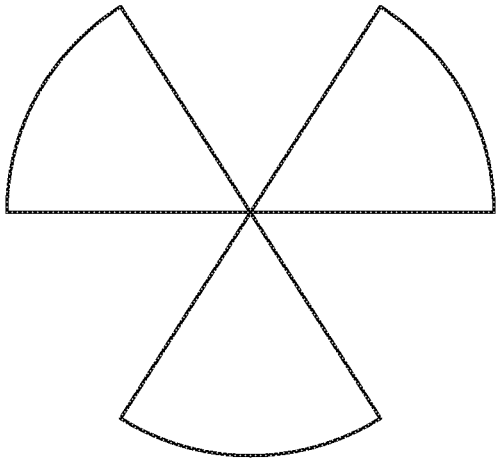
Figure 24:
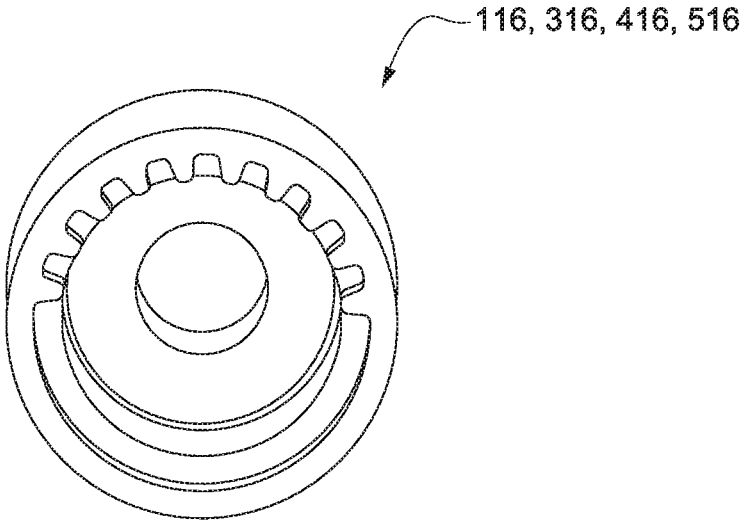
Figure 25:
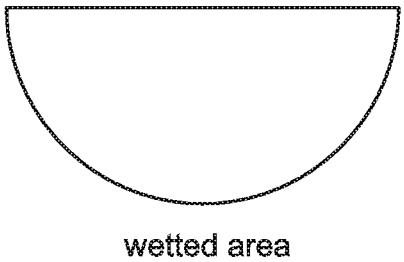
Figure 26:
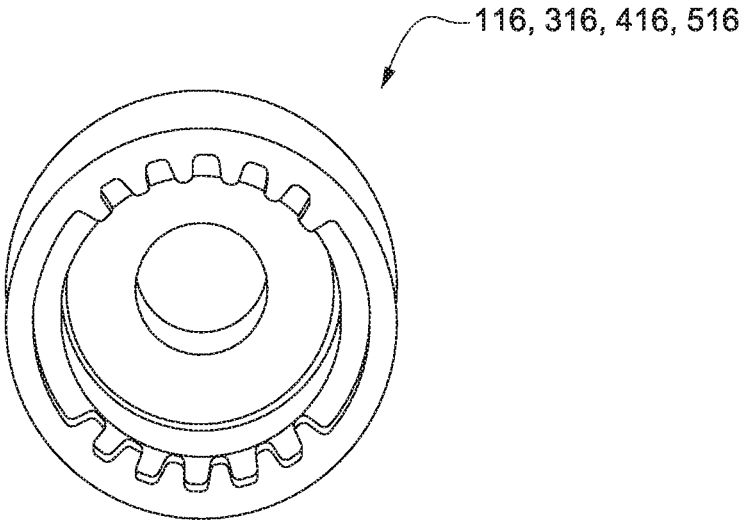
Figure 27:
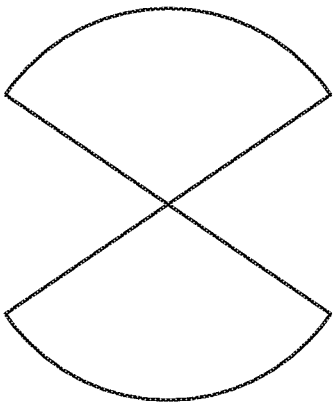
Figure 28:
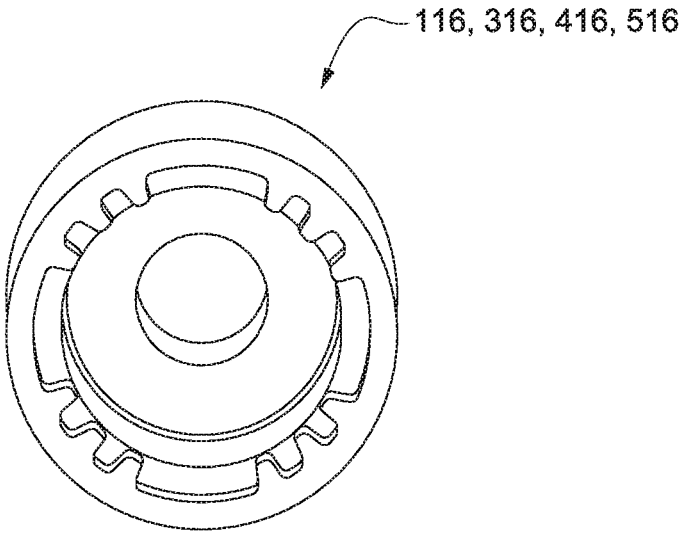
Figure 29:
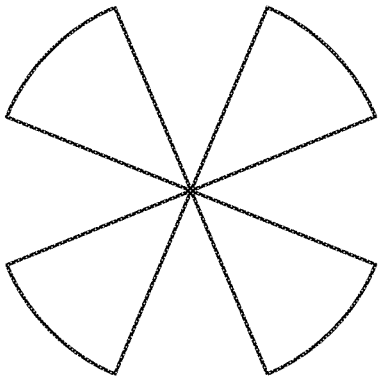
Figure 30:
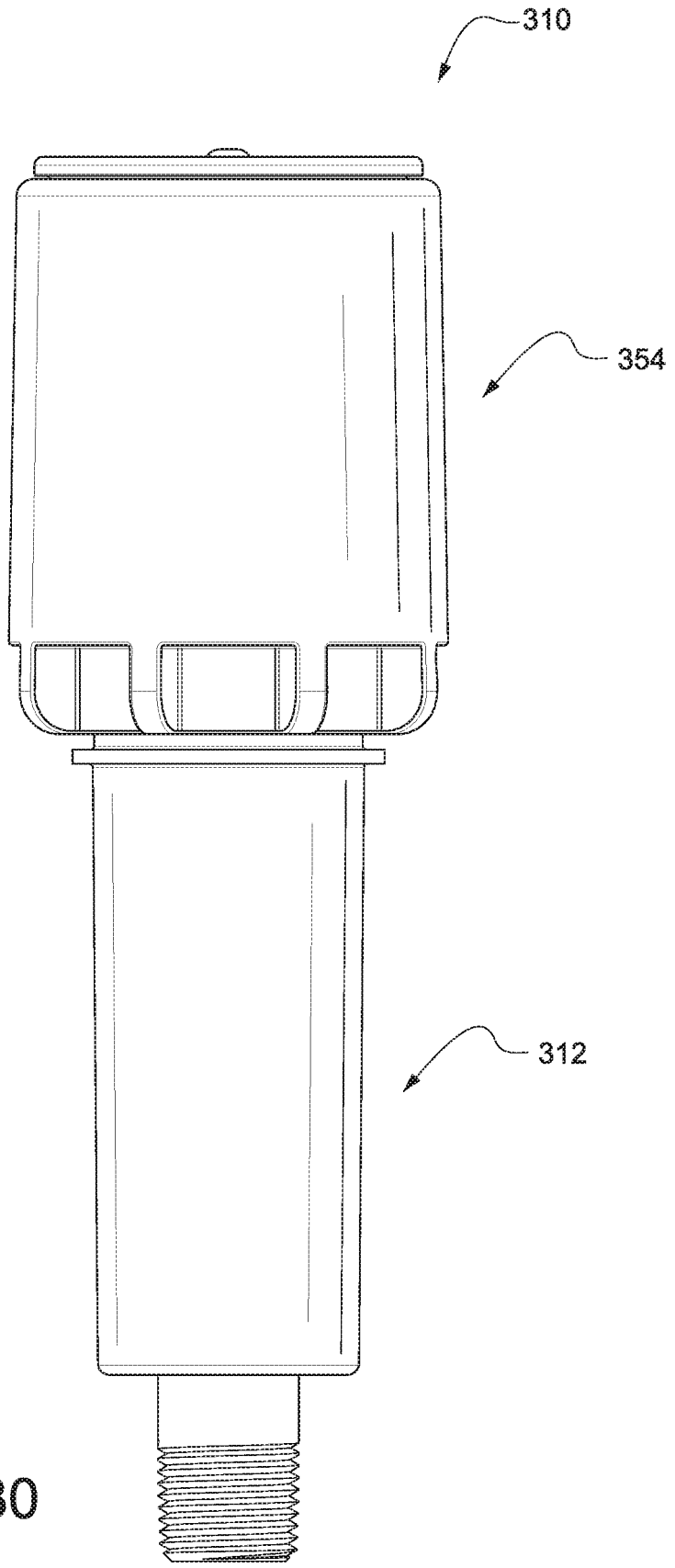
FIG. 30 shows a wobbler-type sprinkler in a pop-up canister.
Figure 31:
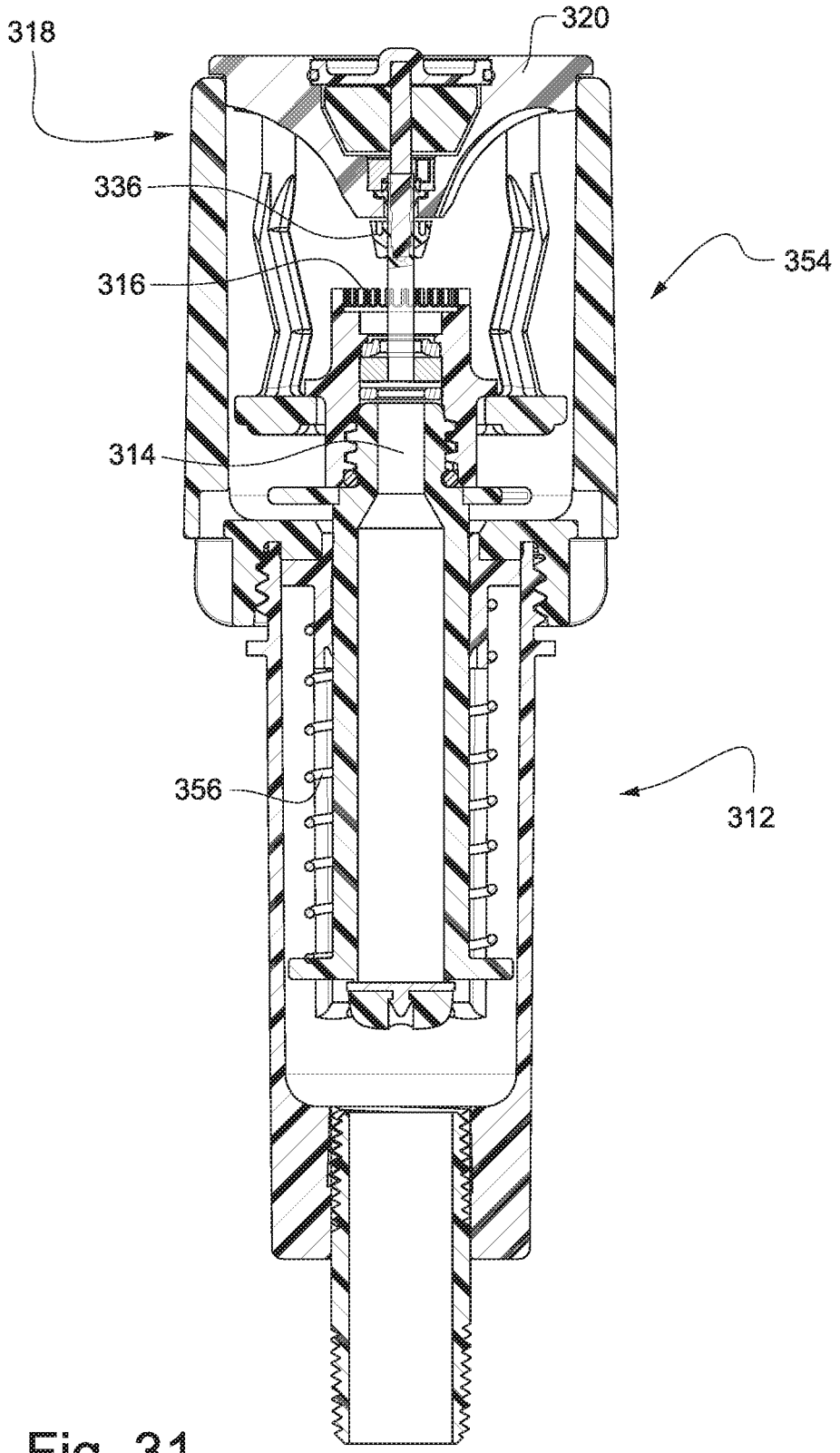
FIG. 31 is a cross-sectional view of the sprinkler head shown in FIG. 30.
Figure 32:
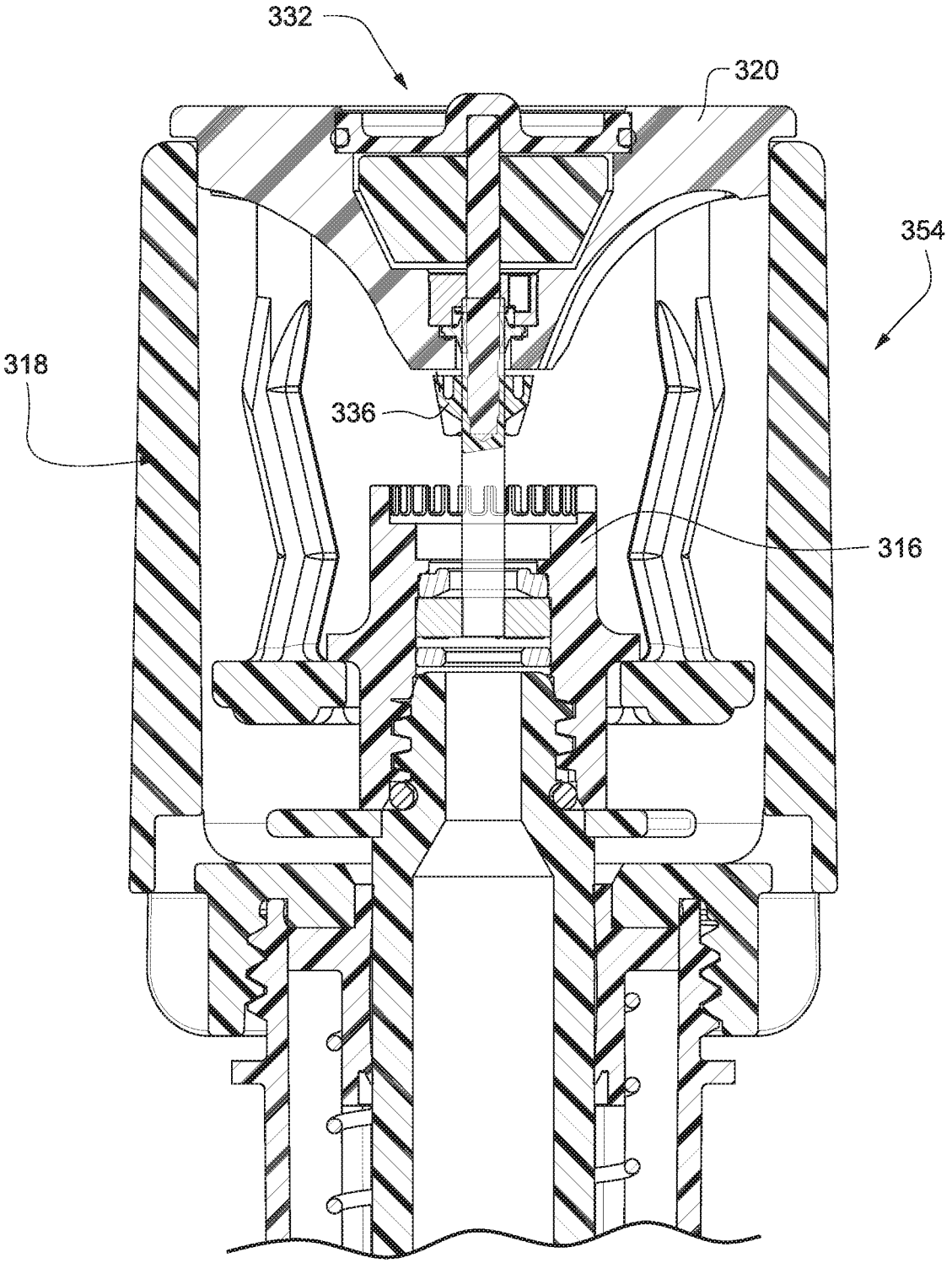
FIG. 32 is a close-up cross-sectional view of the sprinkler head shown in FIG. 31.
Figure 33:
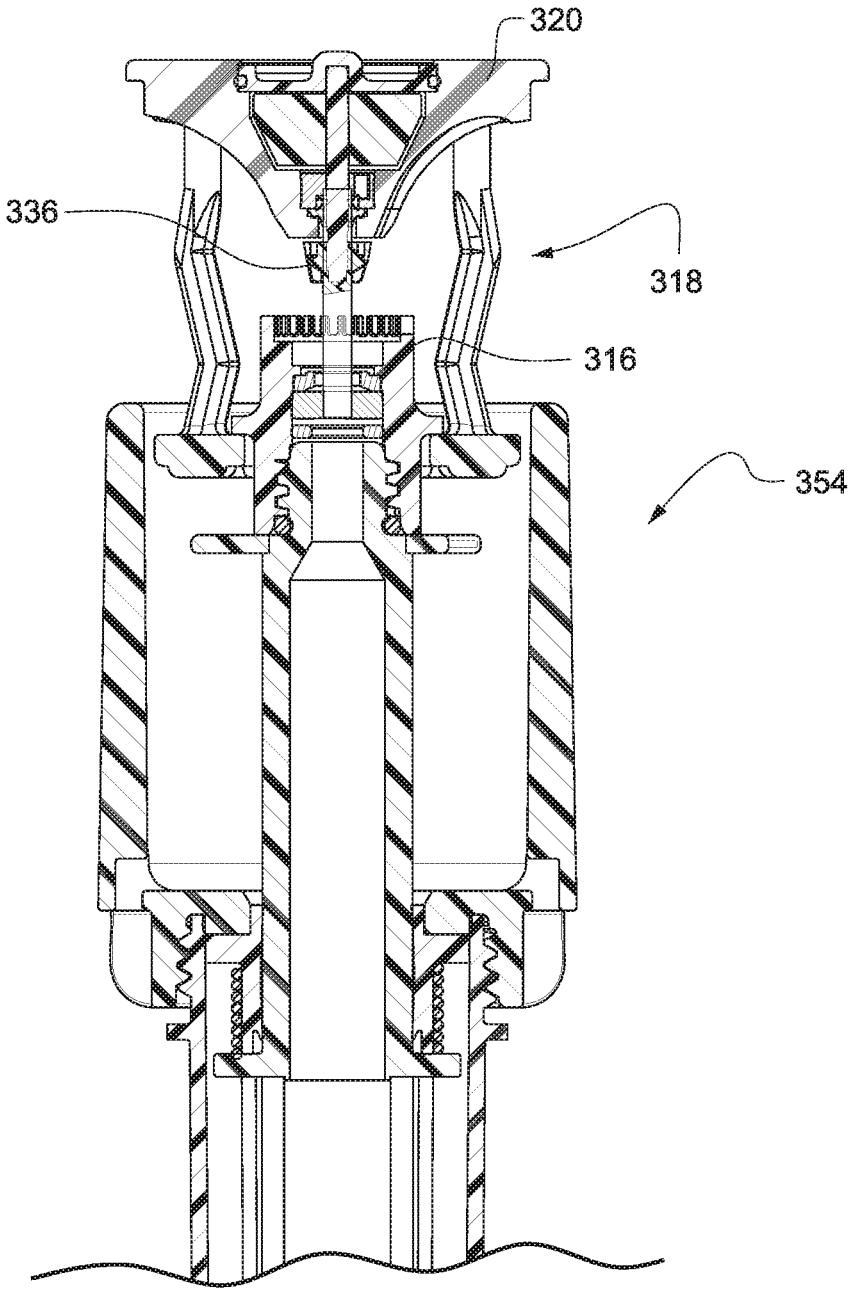
FIG. 33 is a cross-sectional view of the sprinkler head shown in FIG. 31 with the wobbler cage being displaced toward an active position.

In the active position, with reference to FIGS. 8 and 9, the yoke arm 236 engages the fixed sleeve 216 such that the orbital motion of the wobbler cage 218 causes the yoke arm 236 to rotate around the fixed sleeve 216 and also to rotate brake shaft 234, thereby braking the orbital motion of the wobbler cage 218. At rest, as shown in FIGS. 10 and 11, the brake shaft 234 is aligned with the nozzle 214 and the center of the sprinkler body 212.

FIGS. 30-37 illustrate another exemplary alternative embodiment of the wobbler-type sprinkler head 310 according to the present invention. In this embodiment, the nozzle, fixed gear and wobbler cage are selectively disposable in a canister 354. The wobbler cage 318 is displaceable in the canister 354 between a retracted position (FIGS. 30-32 and 37) and an extended position (FIGS. 33-36). Like conventional pop-up sprinkler assemblies, the sprinkler head is typically mounted on a riser or the like. The sprinkler components are biased to the retracted position by a spring 356 secured in the housing 312. The assembly 332 is displaced to its extended position by pressure exerted by the water flow through the nozzle 314. These components and their operation are generally known, and the details thereof will not be further described.

Figure 34:
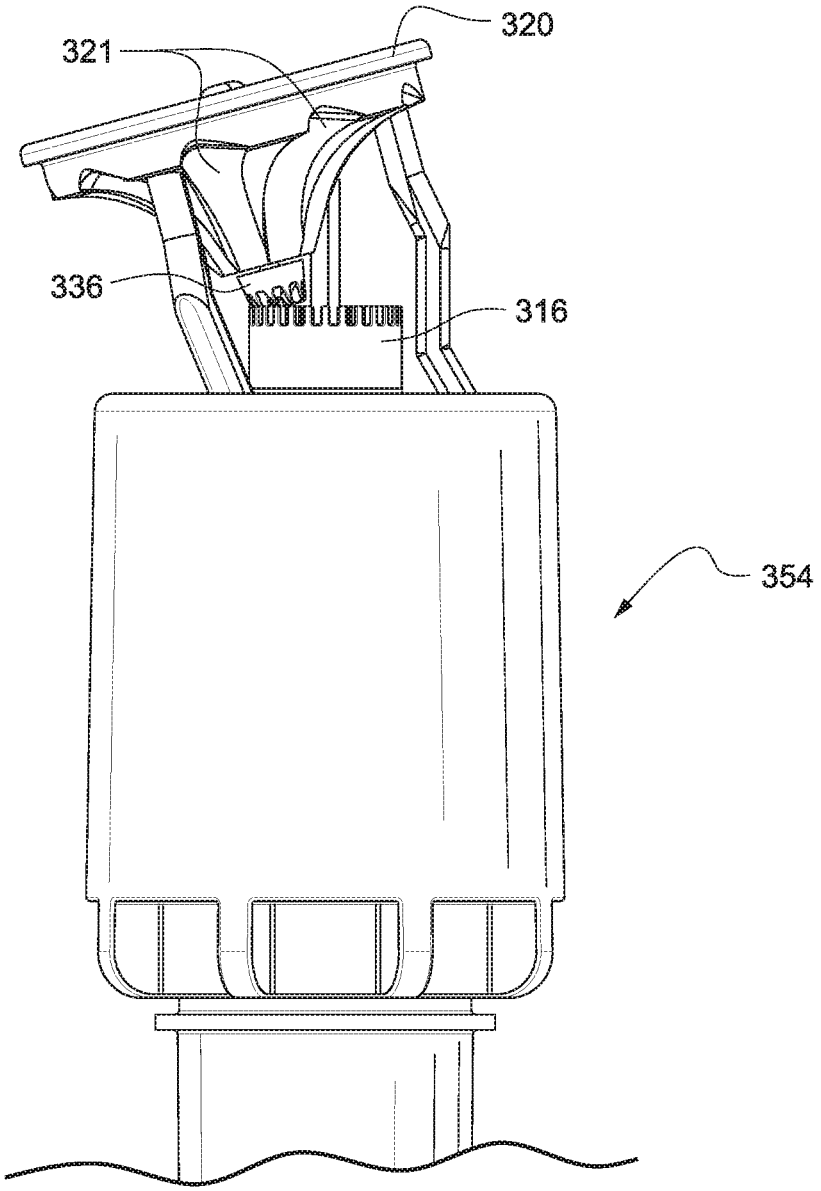
FIGS. 34 and 35 show the sprinkler head of FIG. 31 in an active position.
Figure 35:
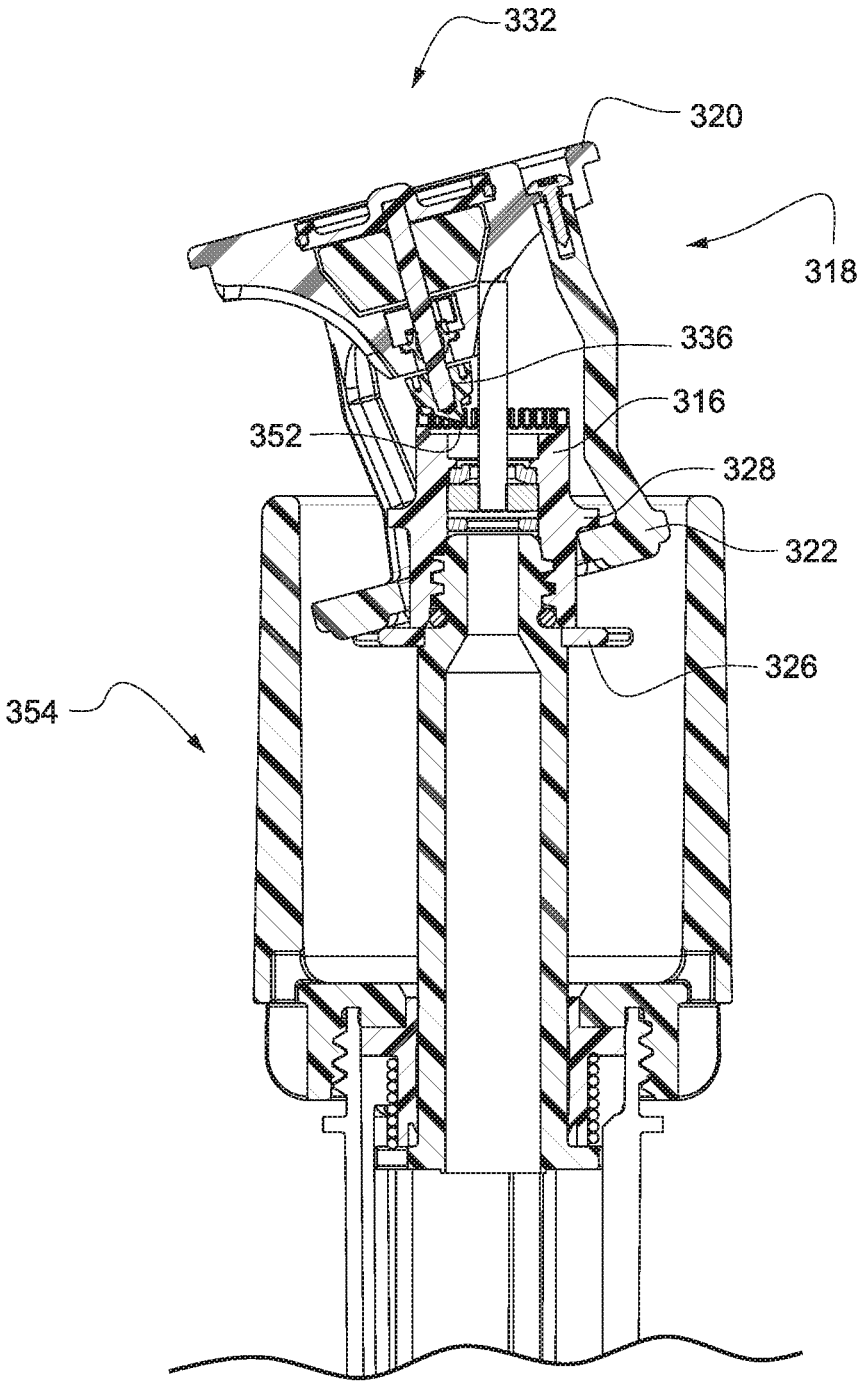
Figure 36:
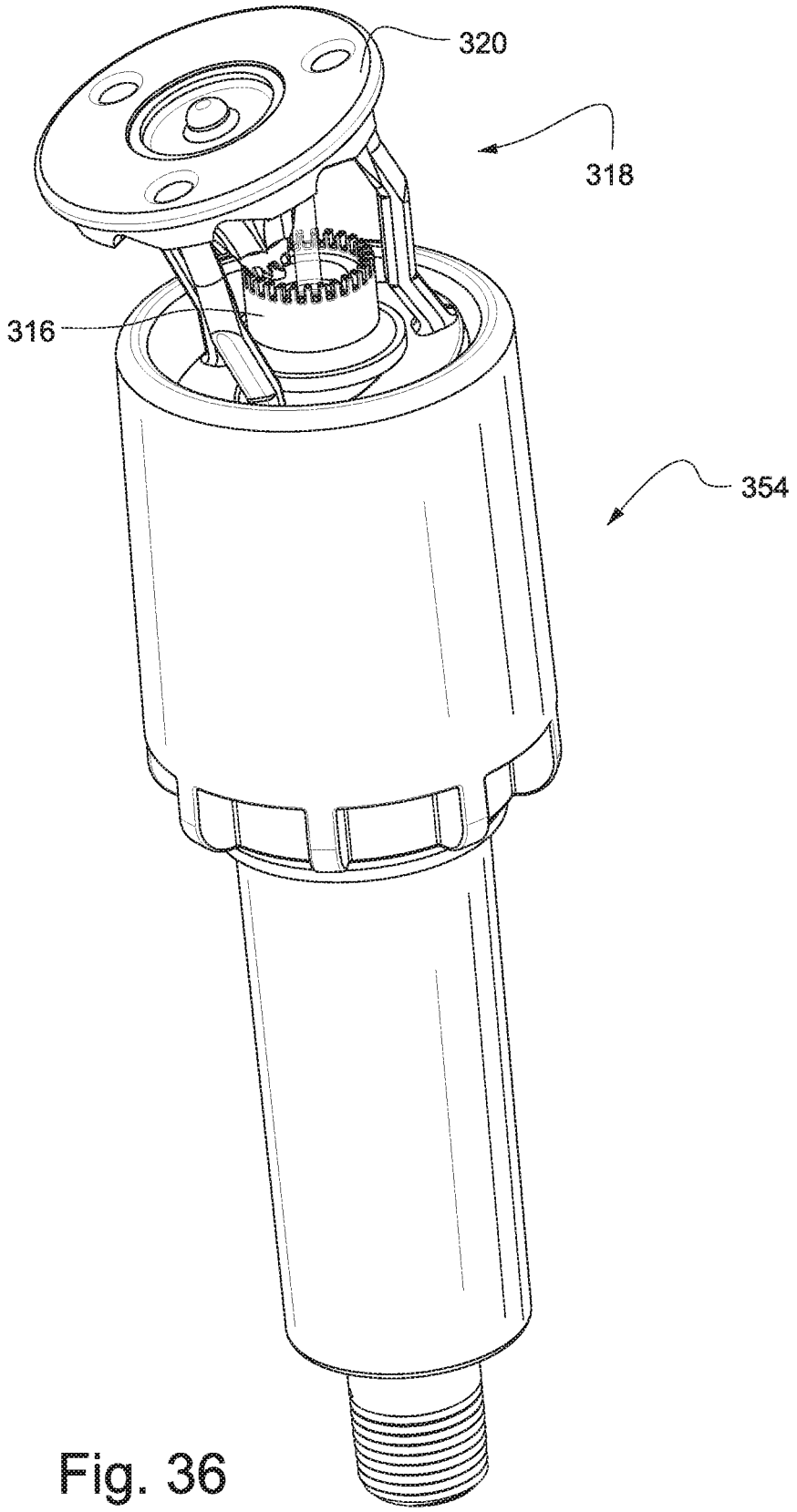
FIG. 36 is a perspective view of the sprinkler head shown in FIG. 31 with the wobbler cage in an active position.
Figure 37:
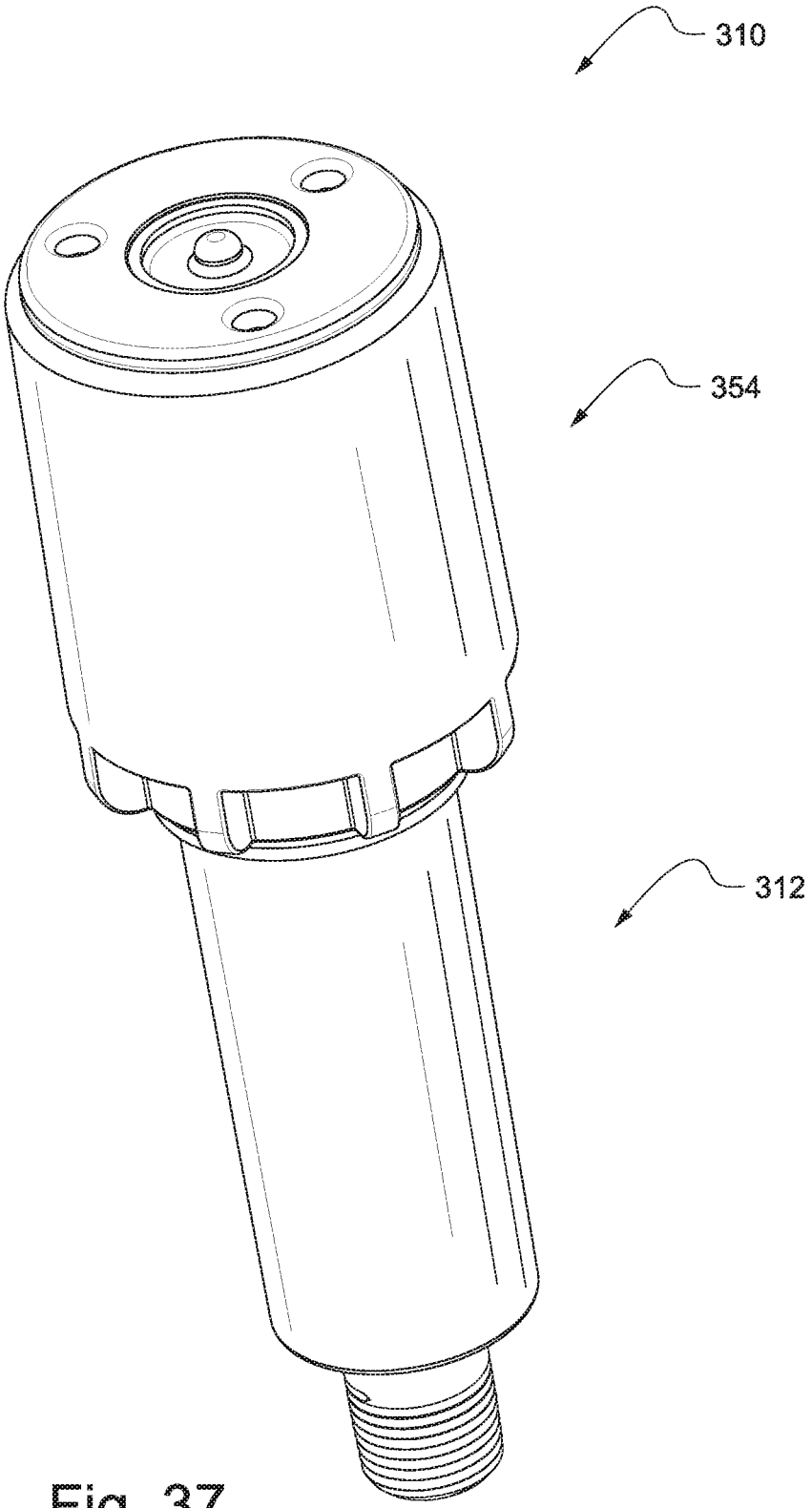
FIG. 37 is a perspective view of the sprinkler head shown in FIG. 31 in a retracted position.
Figure 38:
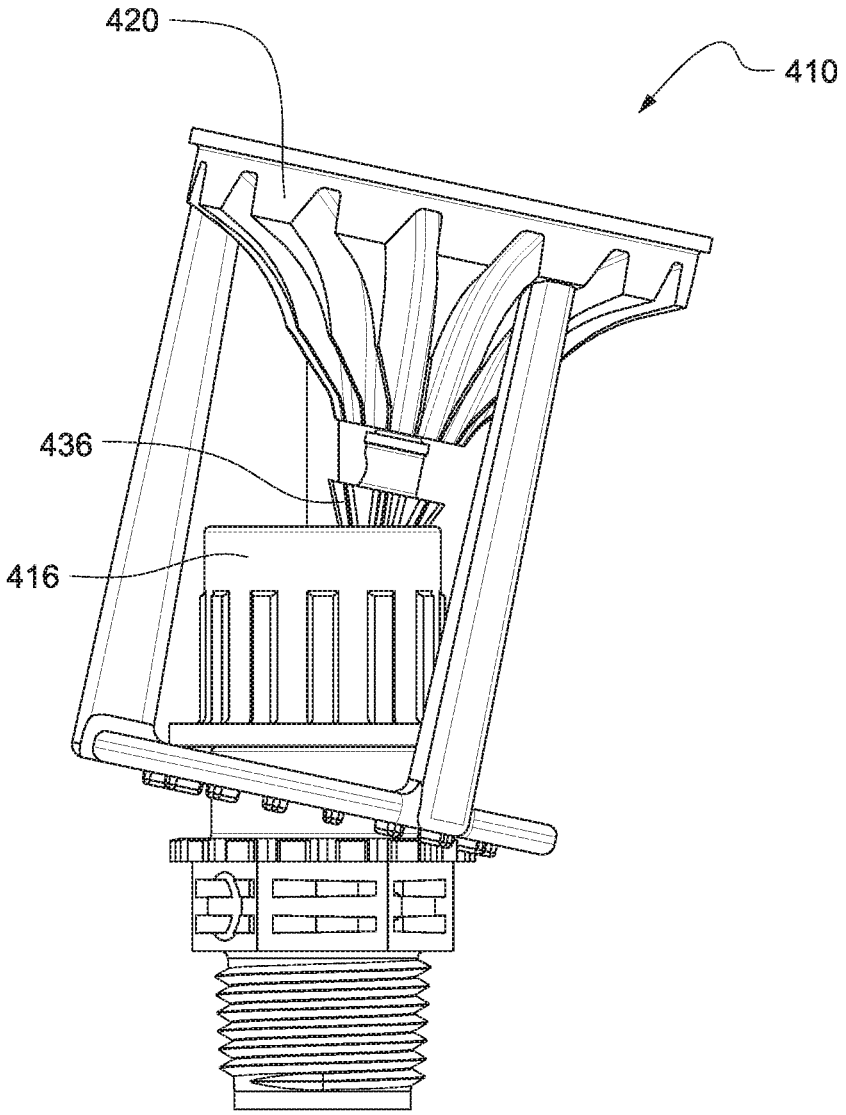
FIG. 38 shows a wobbler-type sprinkler head according to another exemplary embodiment.
Figure 39:
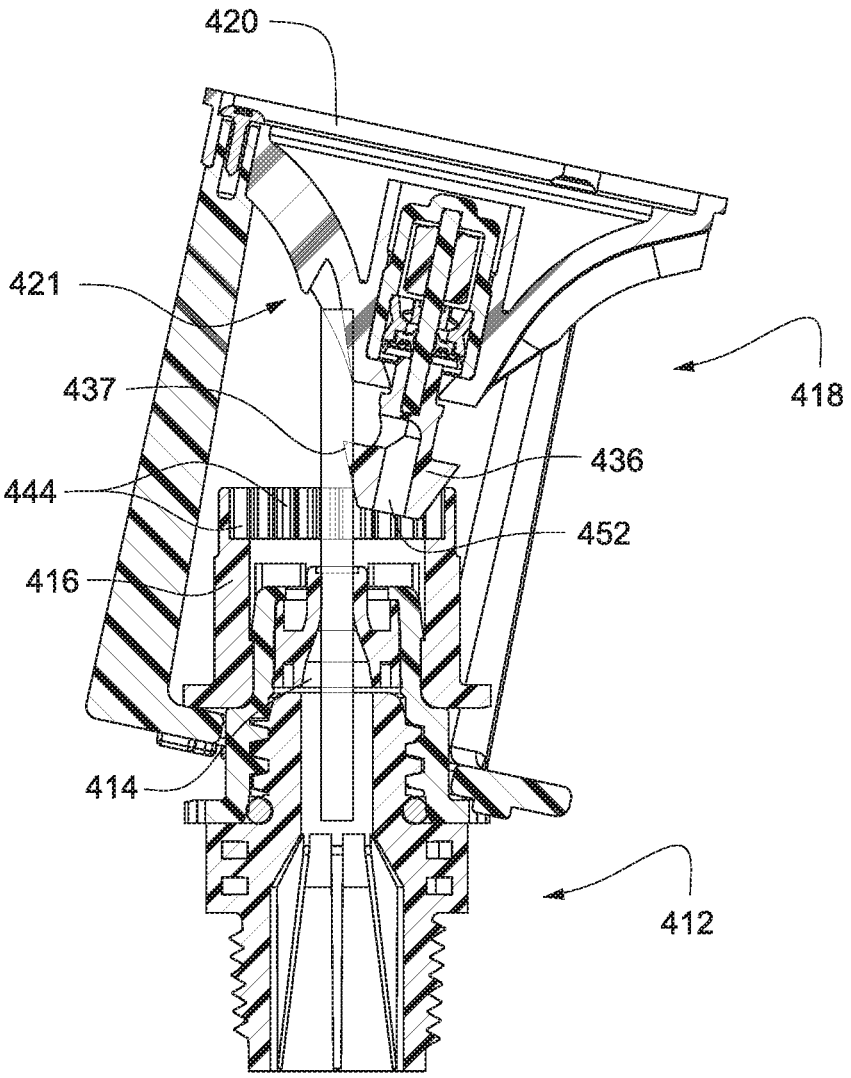
FIG. 39 is a cross-sectional view of the sprinkler head shown in FIG. 38.
Figure 40:
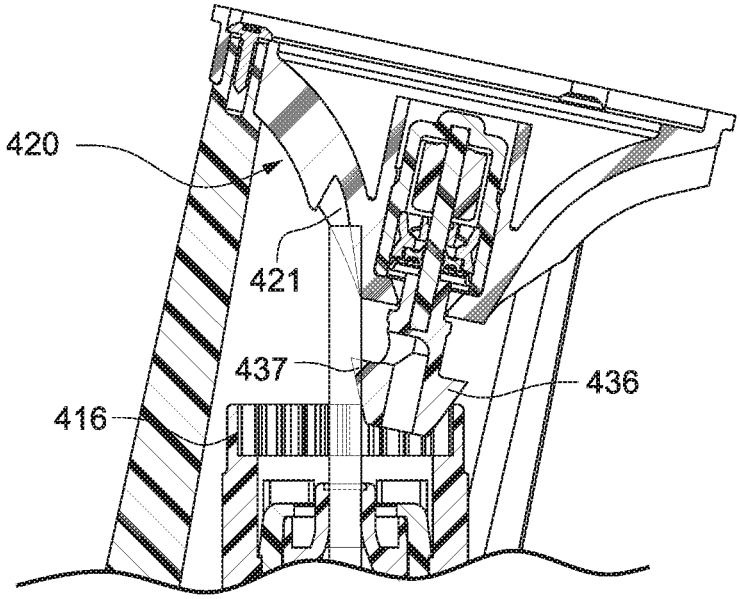
FIG. 40 is a close-up sectional view showing the brake gear engaged with the ring gear.
Figure 41:
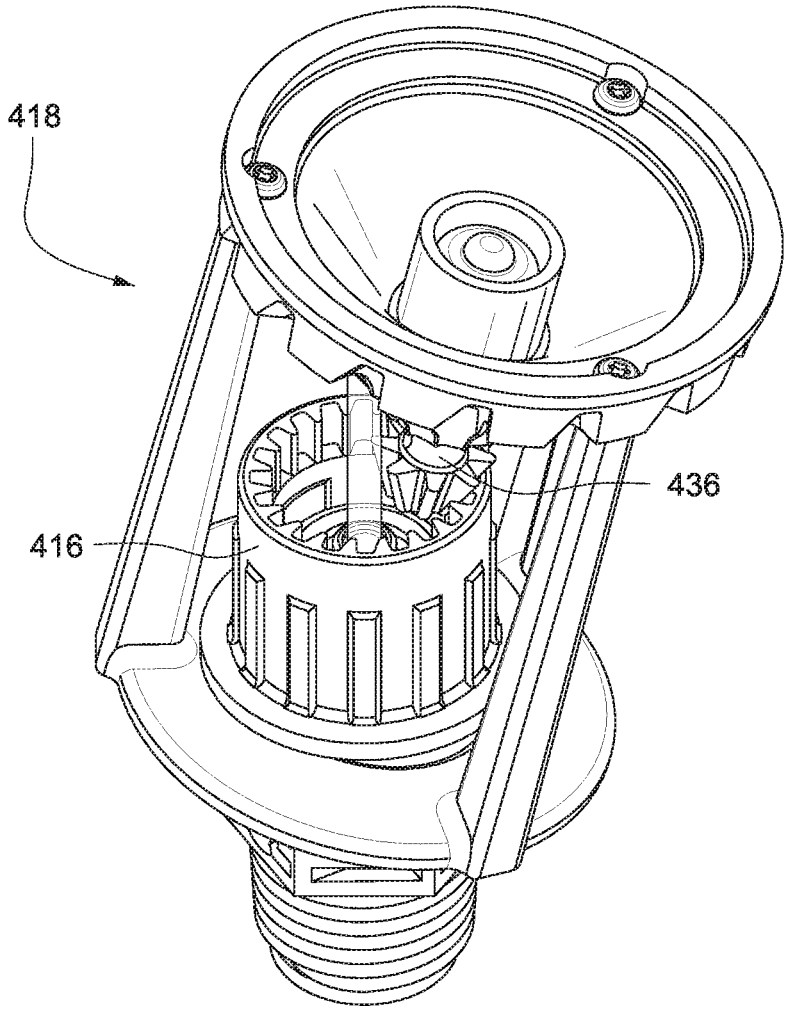
FIGS. 41-43 are perspective views of the sprinkler head shown in FIG. 38.
Figure 42:
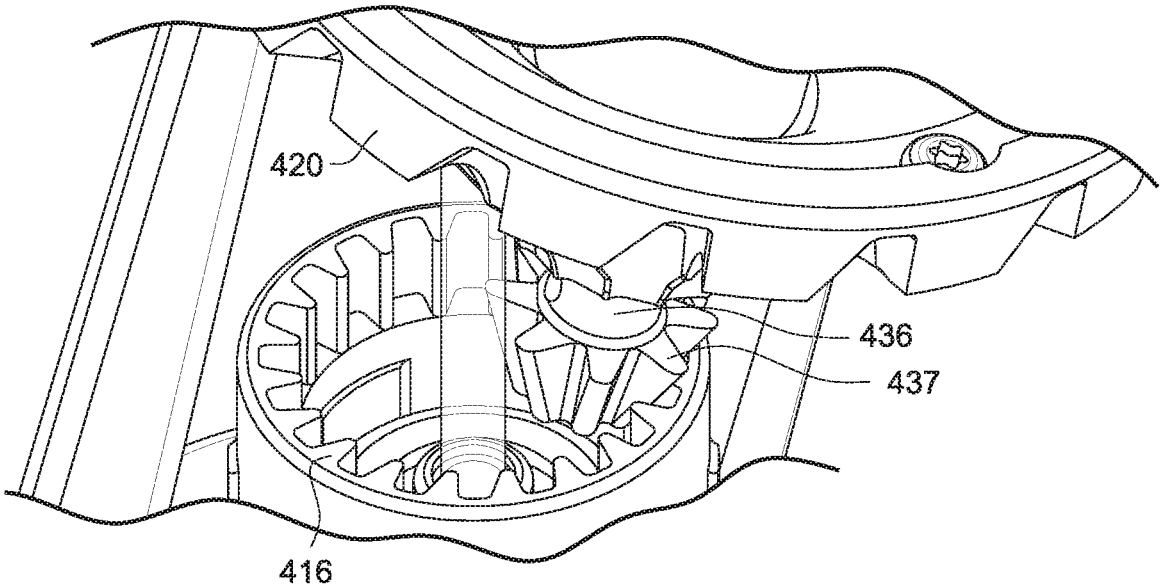
Figure 43:
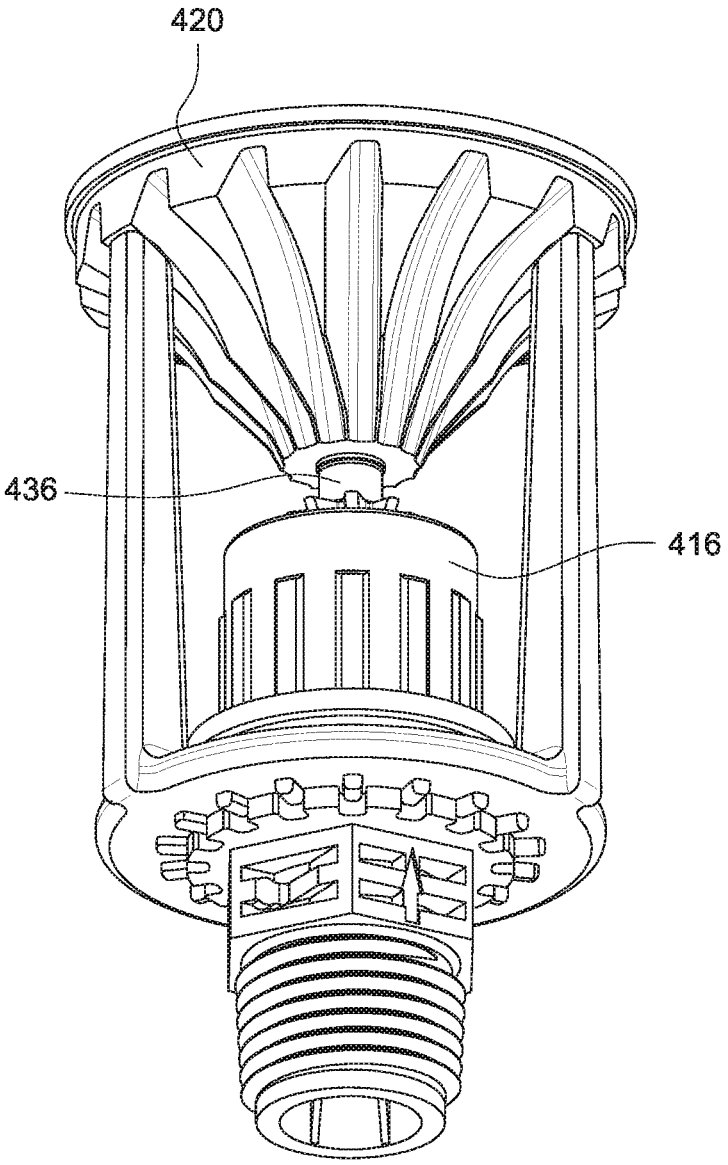
Figure 44:
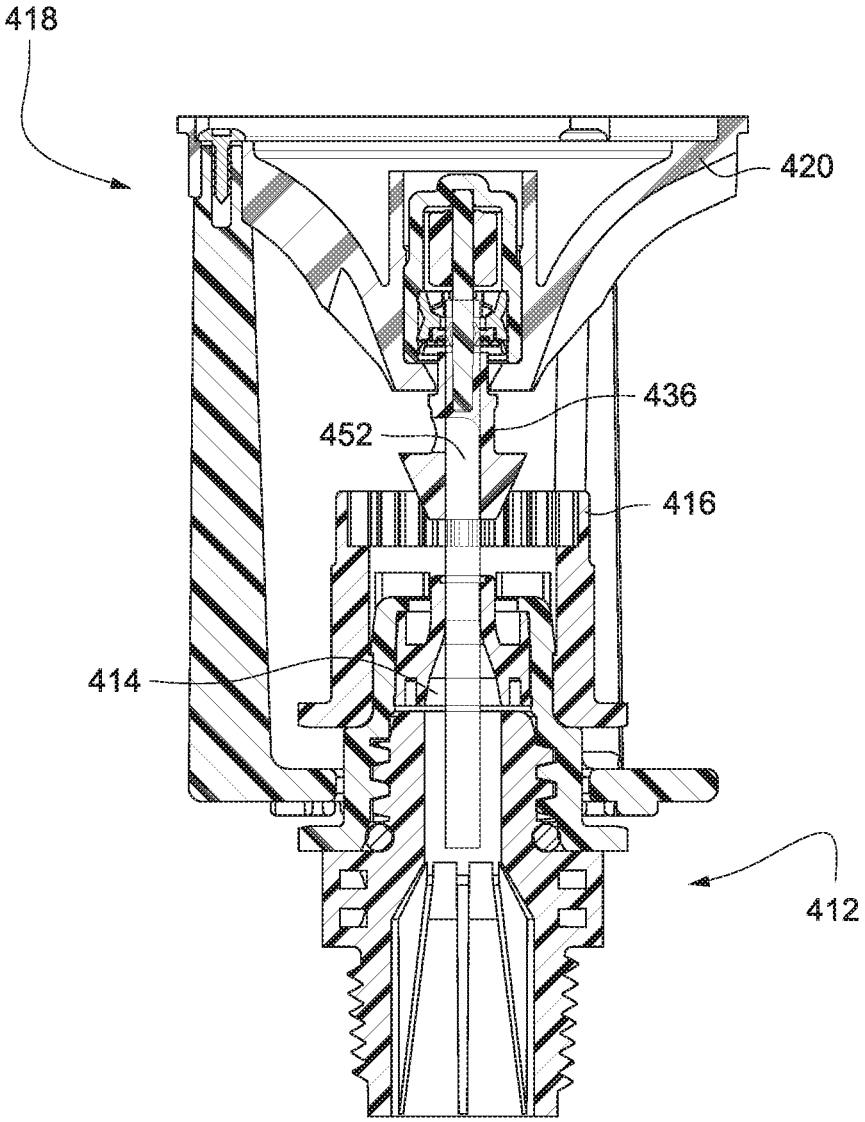
FIG. 44 is a cross-sectional view of the sprinkler head shown in FIG. 38 with the wobbler cage in an inactive position.

In the retracted position, the brake gear 336 is aligned with the nozzle 314 and is coaxial with the fixed gear 316. Once the nozzle 314, wobbler cage 318 and water deflector plate 320 are displaced to the extended position by water flow through the nozzle 314, the wobbler cage 318 is pivotable into a use position as shown in FIGS. 34-36. In the use position, the brake gear 336 is engaged with the fixed gear 316. The shape and orientation of the grooves 321 in the water deflector plate 320 cause the wobbler cage 318 and the water deflector plate 320 to rotate. As shown in FIG. 35, the brake gear 336 is provided at its distal end 352 with an angled surface so that in the resting position, at startup, the water flow impacts the angled surface of the distal end 352 to force the wobbler cage 318 off center. Like prior embodiments, the wobbler ring 322 of the wobbler cage 318 is positioned between a ledge or shoulder 328 of the fixed gear 316 and a gear plate 326. When the water flow is terminated, the spring 356 draws the nozzle 314, the wobbler cage 318 and the water deflector plate 320 back into the canister 354, and the wobbler cage 318 is pivoted back to its rest position shown in FIGS. 31, 32 and 37. Since the wobbler cage 318 is pivotable to the orientation shown in FIGS. 31, 32 and 37, the unit can fit into a relatively small diameter canister. Moreover, during startup, if the water pressure is coming up slowly, while the pressure is still low and the wobbler cage 318 has not tilted over yet, the wobbler cage 318 and deflector plate 320 are free to spin and water will be flowing over the brake gear 336 and into the grooves 321 in the deflector plate 320. This action creates small moving streams that are easy on the soil as compared to many sprinklers that have a very large concentrated, slow-moving stream at startup, which can be erosive to the soil and disturb germinating seeds. At some point, the pressure will get high enough at the angled face of the distal end 352 to create a sufficient force to tilt the wobbler cage 318, and the unit will then operate normally.

FIGS. 38-44 show another alternative embodiment of the wobbler-type sprinkler head according to the invention. The sprinkler head 410 including a sprinkler body 412 is not shown in a pop-up application; but as would be readily apparent to those of ordinary skill in the art, the assembly could be put into a canister for such an application.

In this embodiment, teeth 437 of the brake gear 436 are engageable with corresponding fixed gear teeth 444 of the fixed gear 416. As shown in FIGS. 39-42, the brake gear teeth 437 extend radially into a water stream flowing through the nozzle 414 when the brake gear 436 is engaged with the fixed gear 416 (i.e., in an active/use position as shown in FIGS. 38-43). The teeth 437 of the brake gear 436 intermittently interrupt the stream between the nozzle 414 and the grooves 421 of the deflector plate 420 to further provide intermittent diffusion of the stream to fill in the distribution pattern. In this context, in all embodiments, significant intermittent diffusion of the stream occurs as the plate grooves of the water deflector plate move in and out of the stream during normal rotation of the deflector plate. This embodiment provides additional intermittent diffusion by the radially extended teeth 437 of the brake gear 436.

The brake gear 436 also may be provided with an internal water passage 452. See FIG. 39. The internal water passage 452 includes a bend as shown, which may be a 90-degree turn. In the startup mode, the stream is captured in the passage 452 and then turned by the bend (e.g., 90 degrees) to create an overturning moment to kick the wobbler cage 418 off center into the use position.

Figure 45:
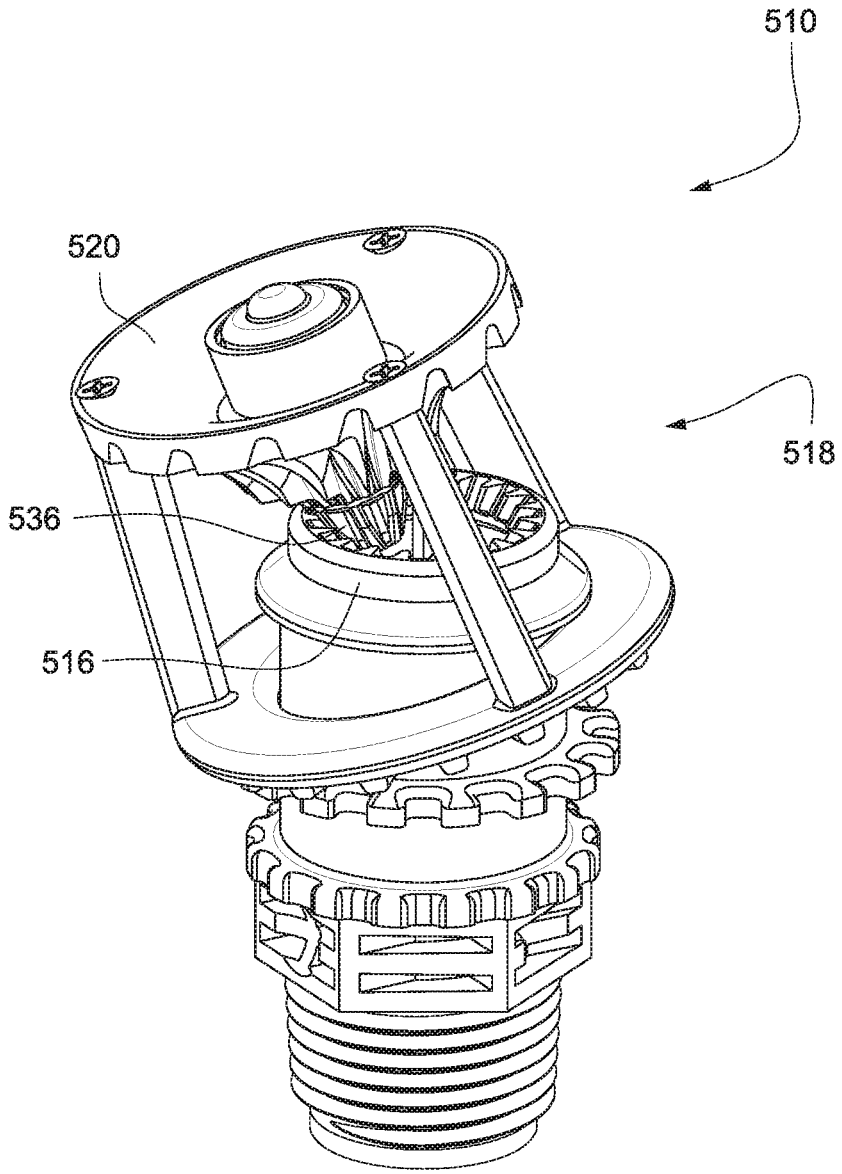
FIG. 45 is a perspective view of a wobbler-type sprinkler head according to another exemplary embodiment.
Figure 46:
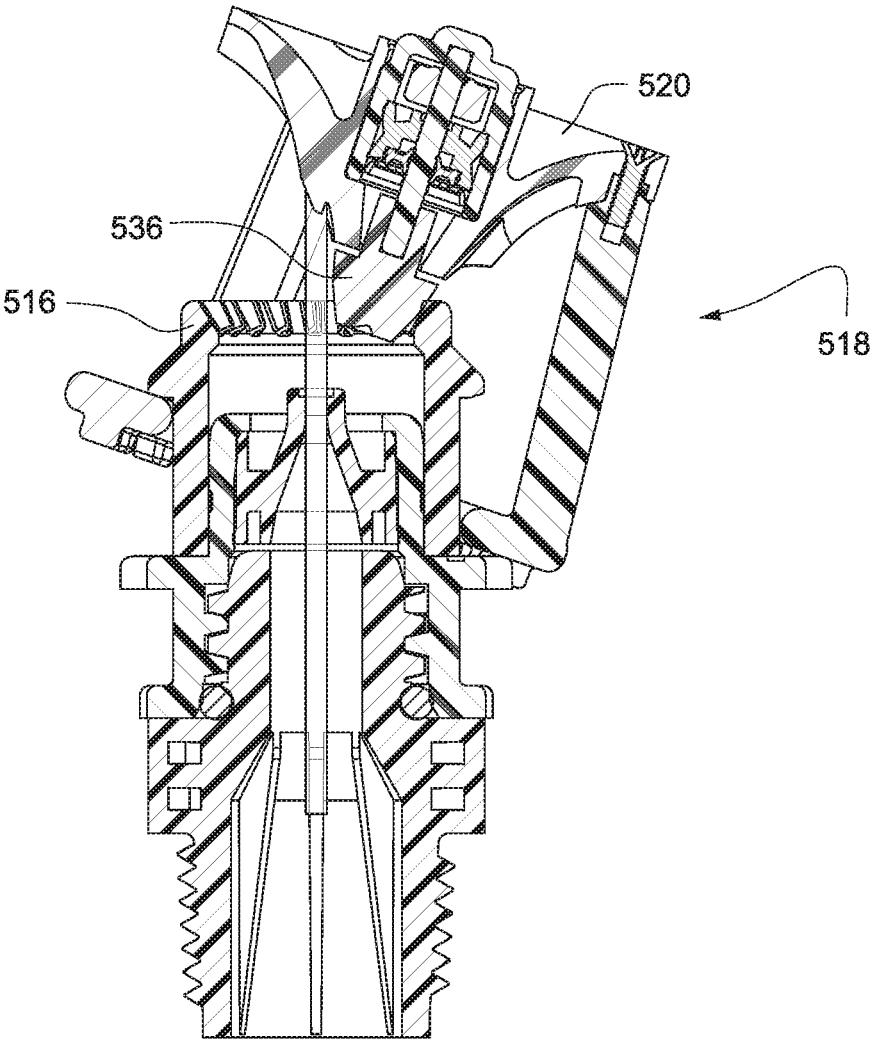
FIG. 46 is a cross-sectional view of the sprinkler head shown in FIG. 45.
Figure 47:
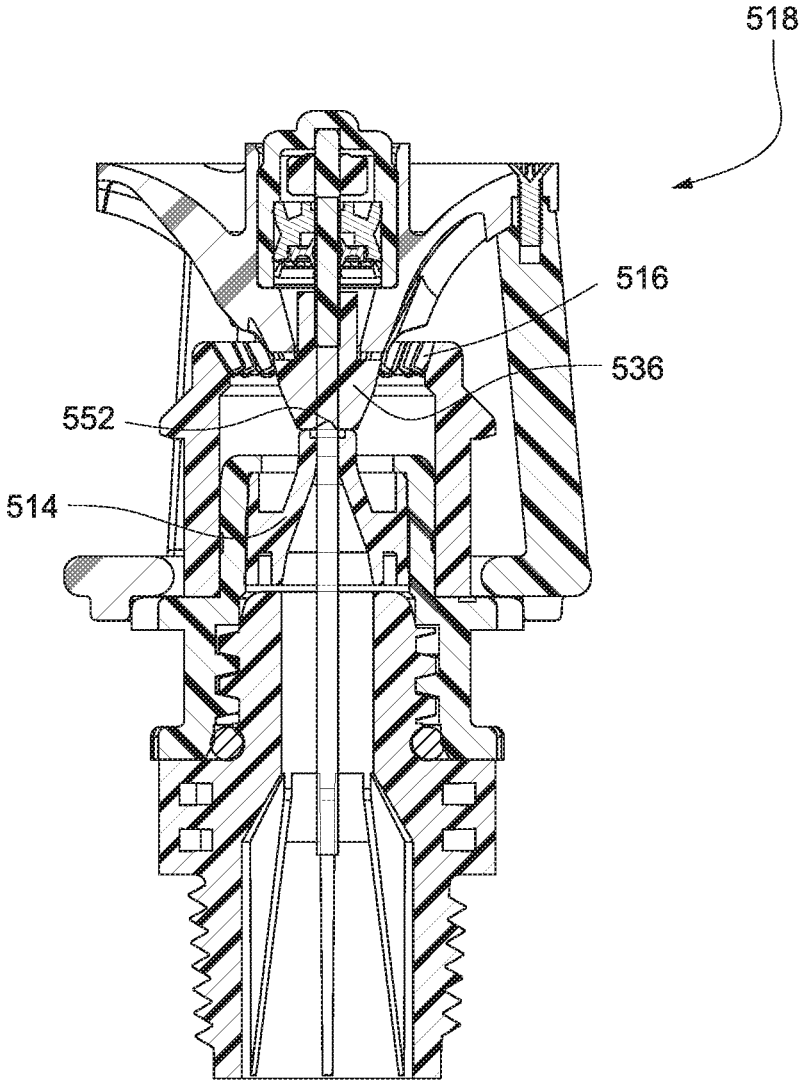
FIG. 47 is a cross-sectional view of the sprinkler head shown in FIG. 45 in an inactive position.
Figure 48:
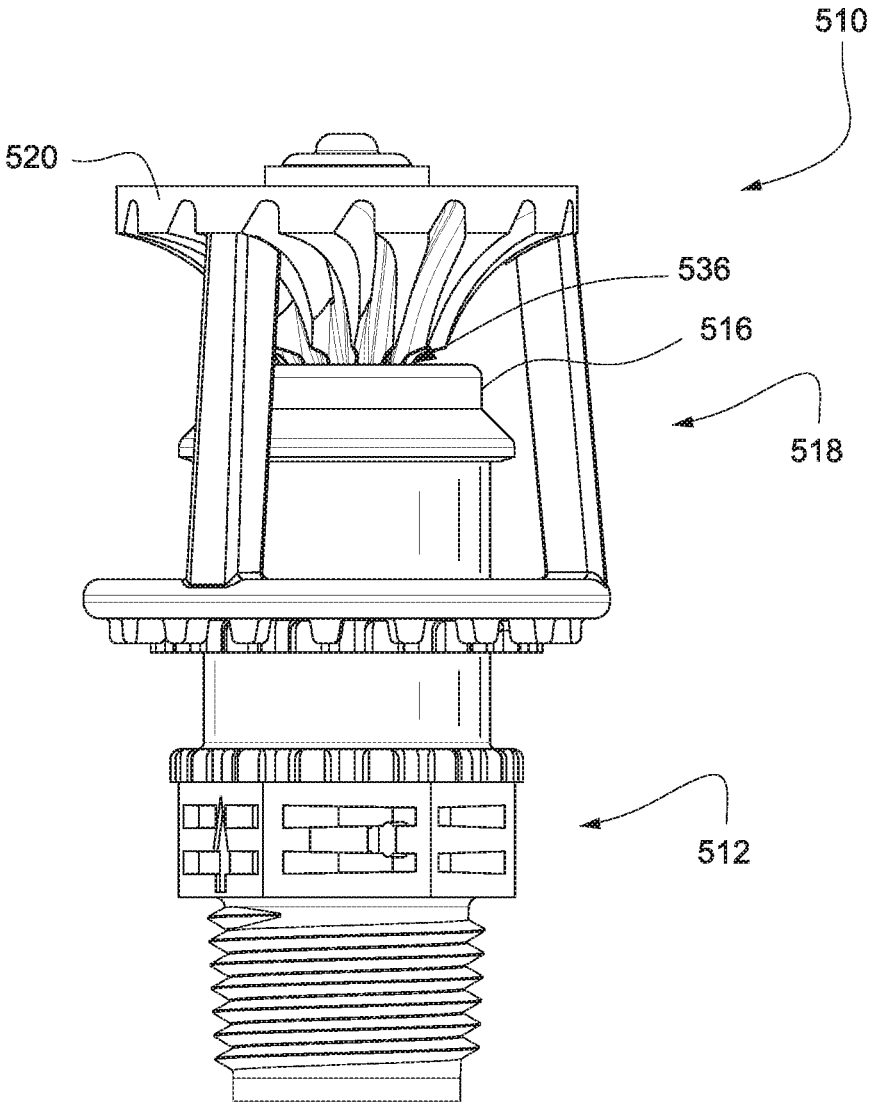
FIG. 48 shows the sprinkler head of FIG. 45 in the inactive position.

FIGS. 45-48 show another alternative embodiment of the wobbler-type sprinkler head 510 including a sprinkler body 512 according to the invention. In this embodiment, the wobbler cage 518 and the water deflector plate 520 are displaceable between the inactive position in which the brake gear 536 is not engaged with the fixed gear 516 (FIGS. 47 and 48) and an active position in which the brake gear 536 is engaged with the fixed gear 516 (FIGS. 45 and 46). In the inactive position, the brake gear 536 rests on the nozzle 514 to cover the nozzle. The capped off nozzle prevents insects from crawling into the nozzle when the unit is off. This feature prevents plugging of small nozzles that are used in certain applications. In this embodiment, the brake gear 536 is provided with an angled notch 552 in a surface facing the nozzle 514 to push the wobbler cage 518 and the deflector plate 520 toward the offset use position at startup.

Figure 49:
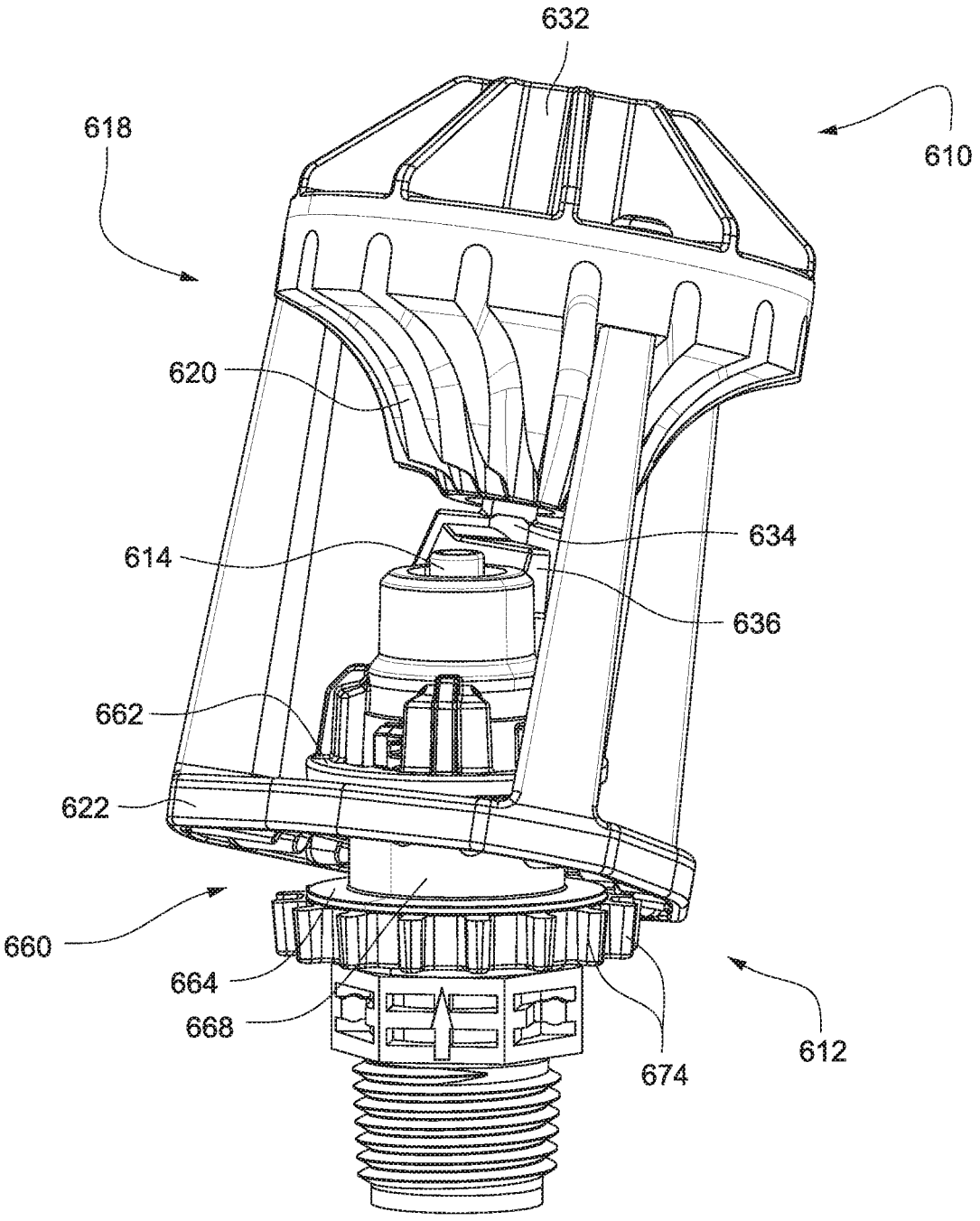
FIGS. 49-53 show a modification of the wobbler-type sprinkler head incorporating a smooth rolling surface for the wobbler ring.
Figure 50:
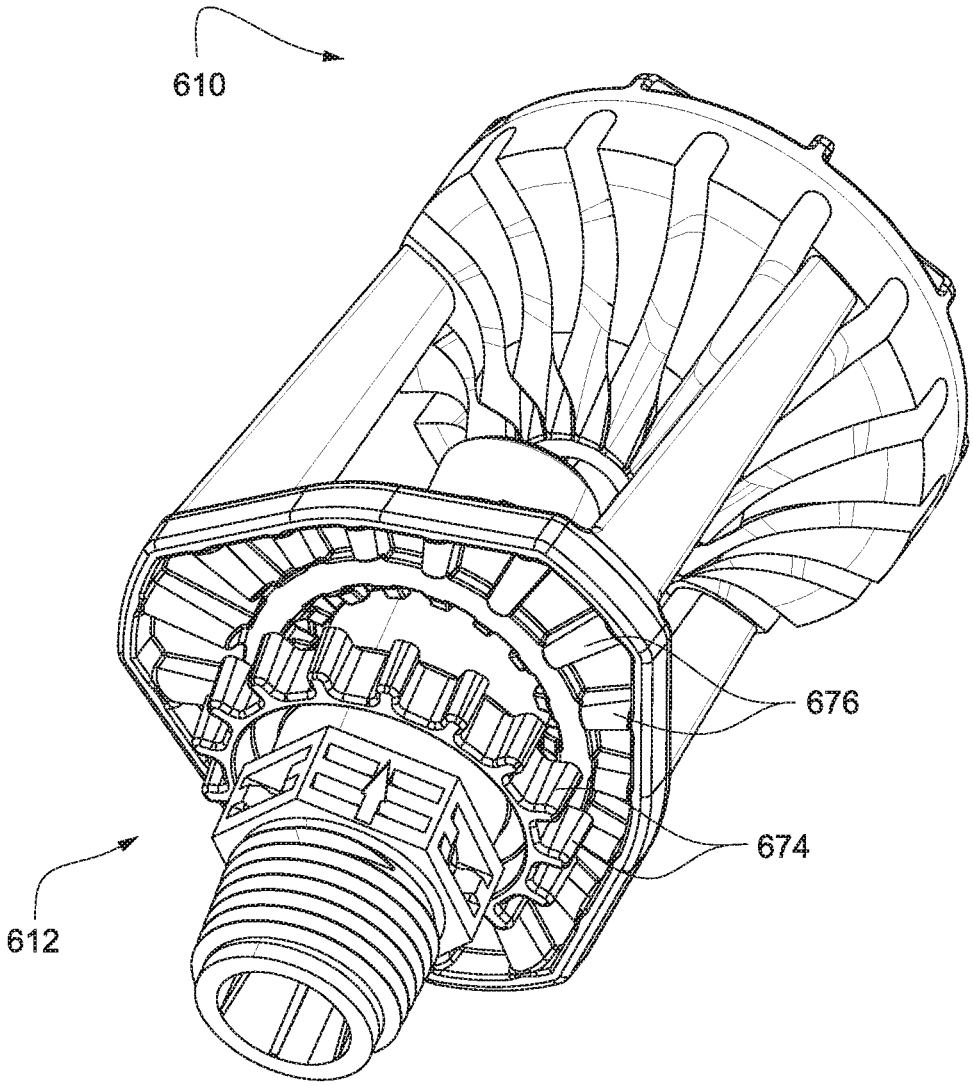
Figure 51:
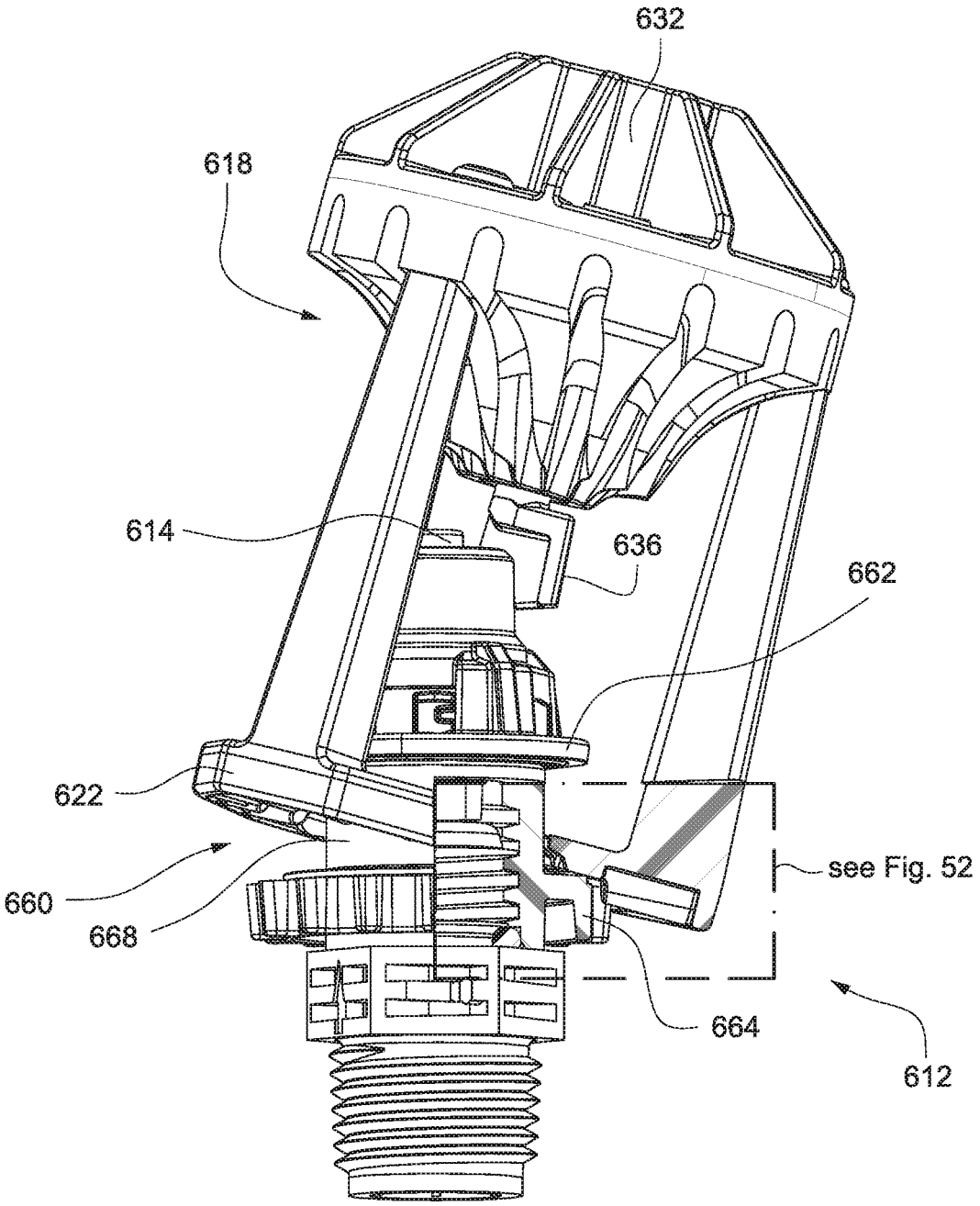

FIGS. 49-58 show variations of the wobbler-type sprinkler head 610 including a sprinkler body 612 according to the invention. As shown in FIGS. 49 and 51, the sprinkler body 612 includes a spool section 660 with facing spool flanges 662, 664 on opposite sides of a spool core 668. A nozzle 614 is positioned within the sprinkler body 612. A wobbler cage 618 includes a wobbler ring 622 supported on the spool section 660. Specifically, the wobbler ring 622 is positioned between the spool flanges 662, 664 and surrounds the spool core 668. A water deflector plate 620 is coupled with the wobbler cage 618 as shown and is positioned downstream of the nozzle 614.

The brake assembly 632 is coupled with the water deflector plate 620 for slowing a rotating and wobbling motion of the wobbler cage 618 and the water deflector plate 620. Like the above embodiments, the brake assembly 632 includes a shaft 634 extending through the water deflector plate 620 and a yoke arm 636 disposed at an end of the shaft 634. The yoke arm 636 is engageable with the sprinkler body 612.

Figure 52:
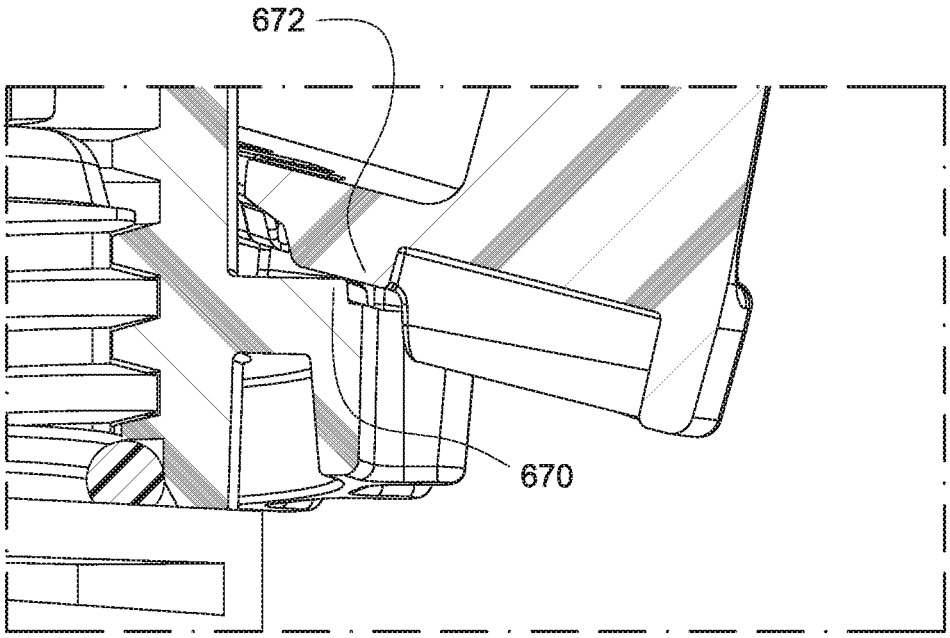
Figure 53:
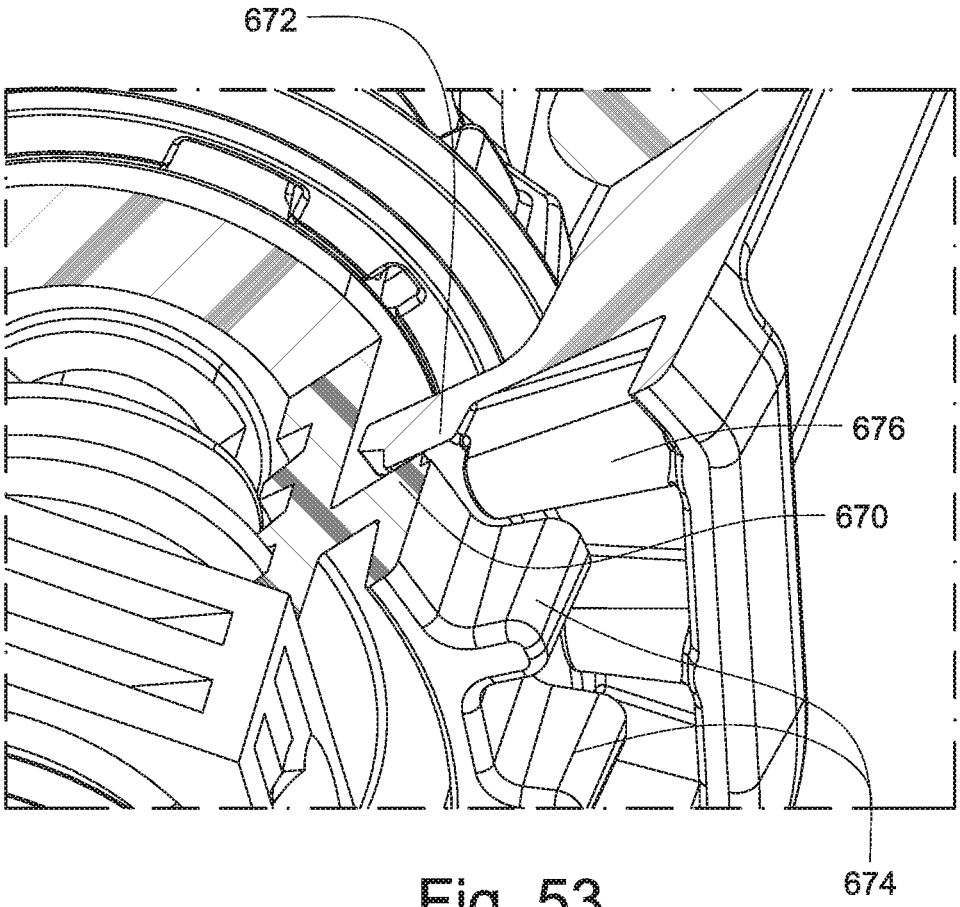
Figure 54:
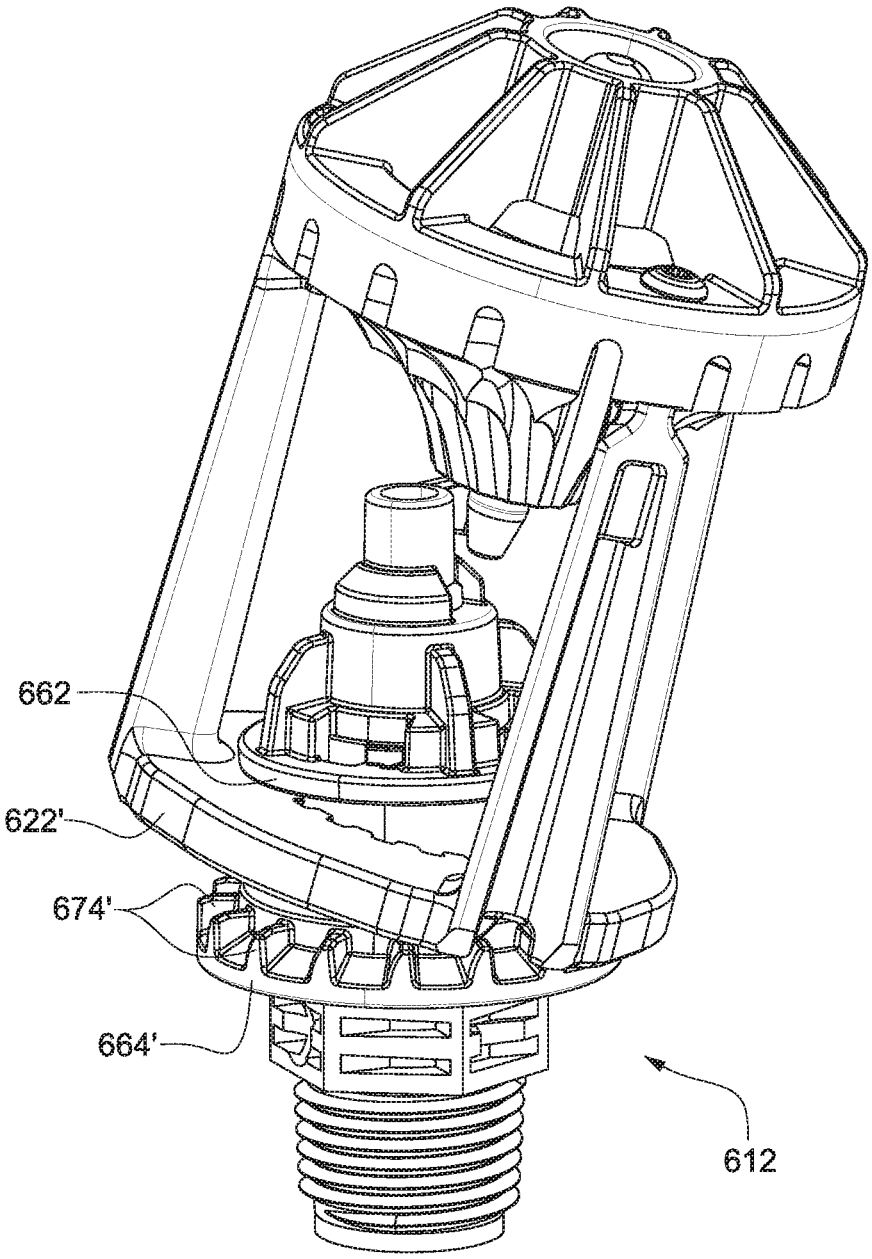
FIGS. 54-58 show a variation of the assembly with the smooth rolling surface.
Figure 55:
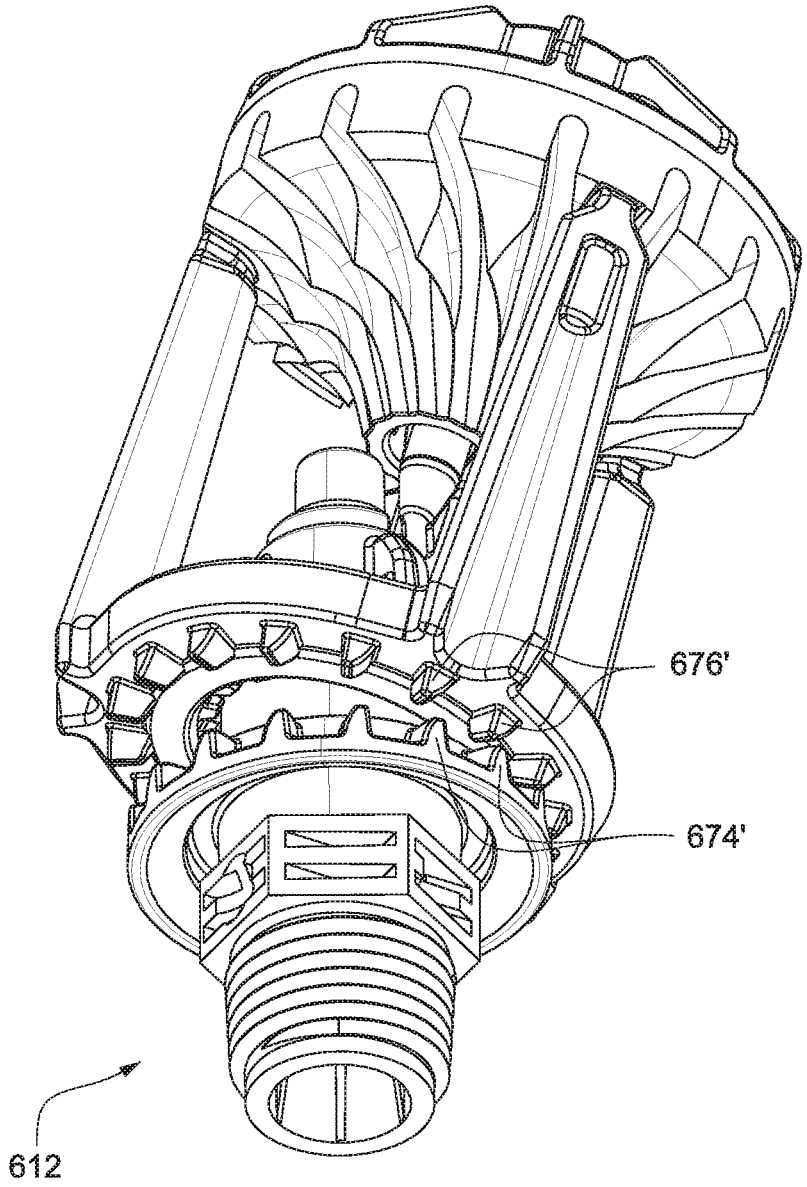
Figure 56:
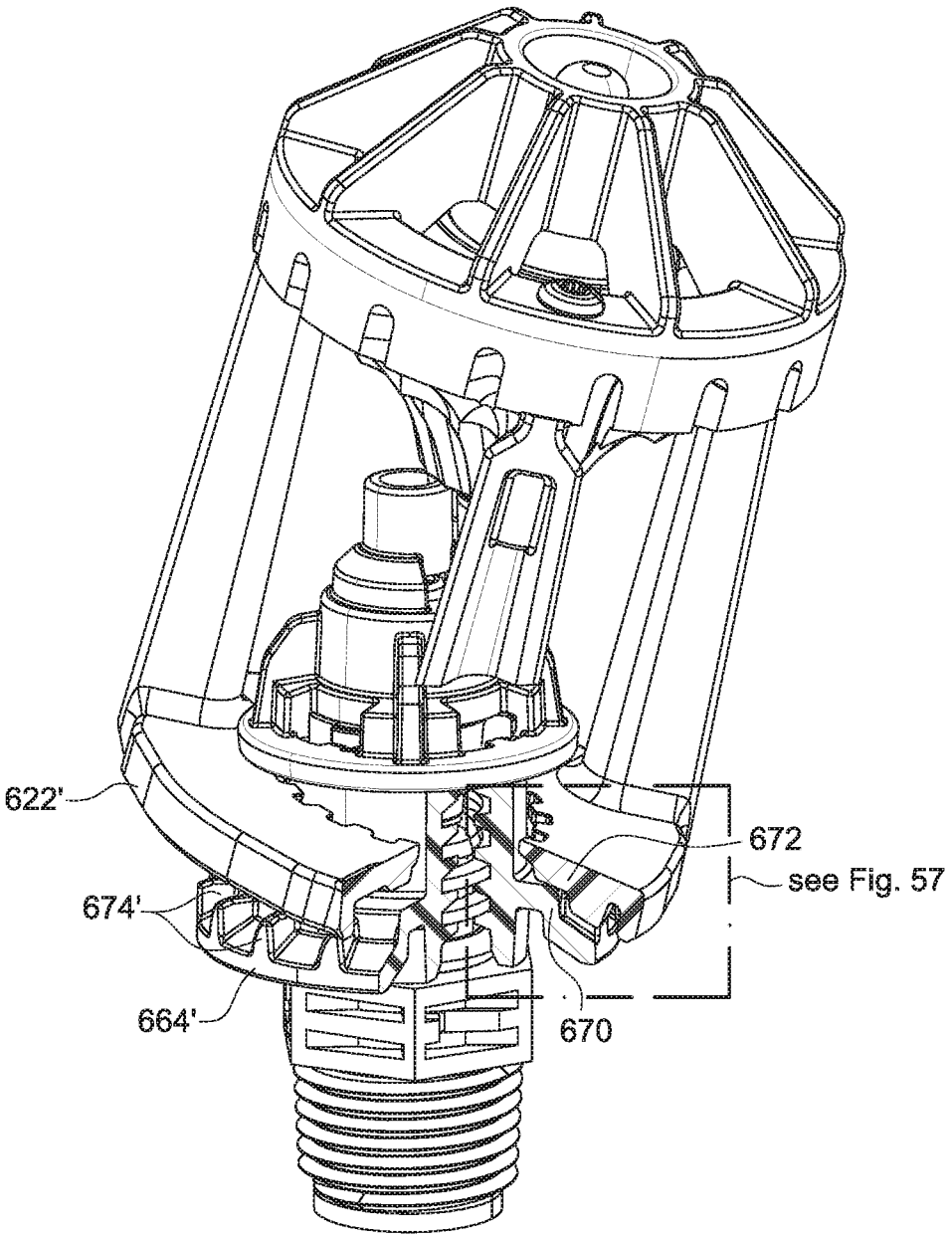
Figure 57:
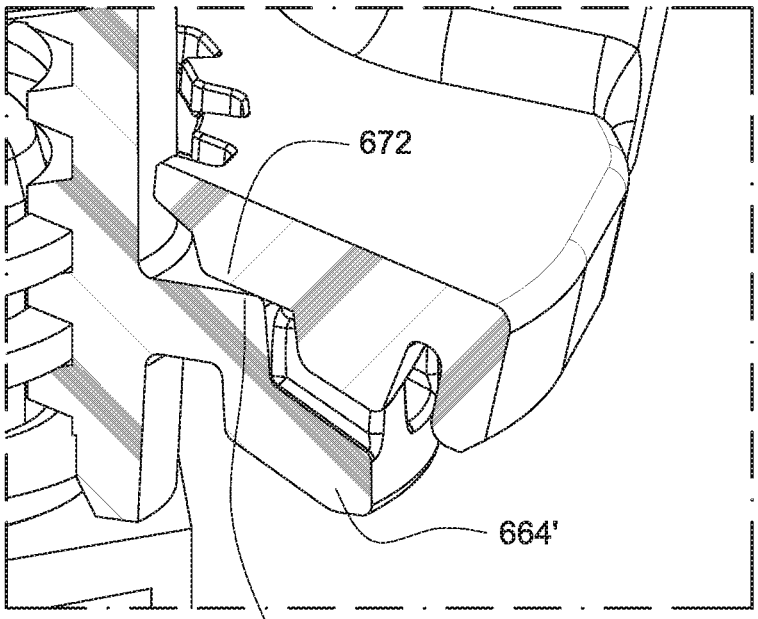
Figure 58:
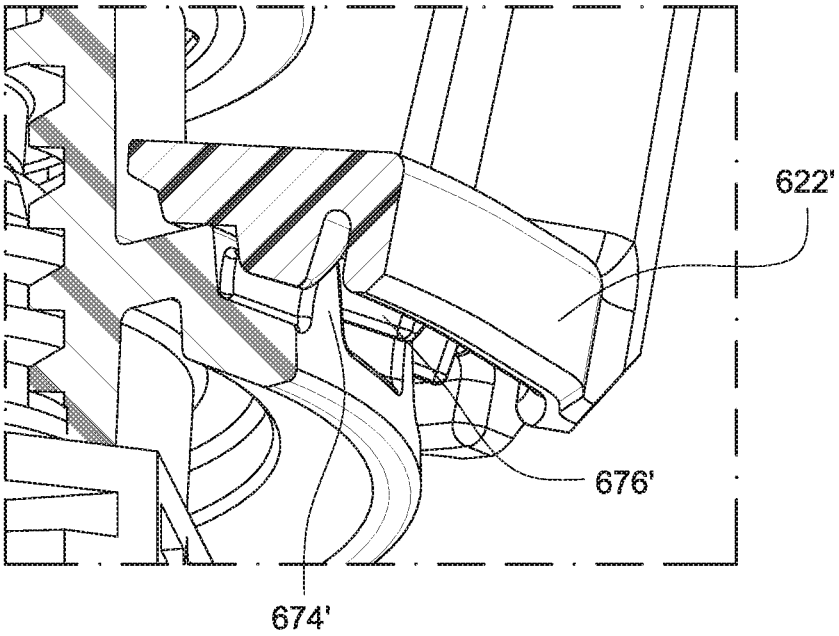

FIGS. 52 and 53 are close-up views showing the wobbler ring 622 engaging the bottom spool flange 664. At least one of the spool flanges 662, 664 includes a circumferential rolling ledge 670. An underside of the wobbler ring 622 is provided with a circumferential rolling surface 672 that engages a circumferential rolling ledge 670 of the spool flange(s). In the embodiment shown in FIGS. 49-53, the circumferential rolling ledge 670 is provided on the bottom or upstream spool flange 664.

In some embodiments, spool teeth 674 are positioned on an outside circumference of the upstream spool flange 664. As shown, the underside of the wobbler ring 622 may be provided with wobbler teeth 676 positioned radially outward of the circumferential rolling surface 672. In use, the wobbler teeth 676 are positioned in spaces defined between the spool teeth 674 without physically engaging the spool teeth 674. In the embodiment shown in FIGS. 49-53, the spool teeth 674 extend radially from an outside circumference of the spool flange 664.

The embodiment shown in FIGS. 54-58 includes similar components to the embodiment shown in FIGS. 49-53. In this embodiment, the spool teeth 674' extend axially from the spool flange 664' with the circumferential rolling ledge 670. In use, the wobbler teeth 676' are positionable in spaces defined between the spool teeth 674'.

As shown, the spool teeth 674' may be tapered from a bottom to a top or include a beveled edge at the top. If the wobbler ring 622' slips on the spool flanges 664', the front surfaces on the spool teeth 674' and the wobbler teeth 676' will roll against one another, preventing further slip. Additionally, leading edges of the spool teeth 674' may be closer to vertical than trailing edges of the spool teeth 674'. Because the sprinkler is intended to orbit only in one direction, the wobbler ring 622' will slip in only one direction, and thus, these surfaces of the teeth 674', 676' are made more vertical so as to provide additional clearance between the teeth 674', 676'.

Figure 59:
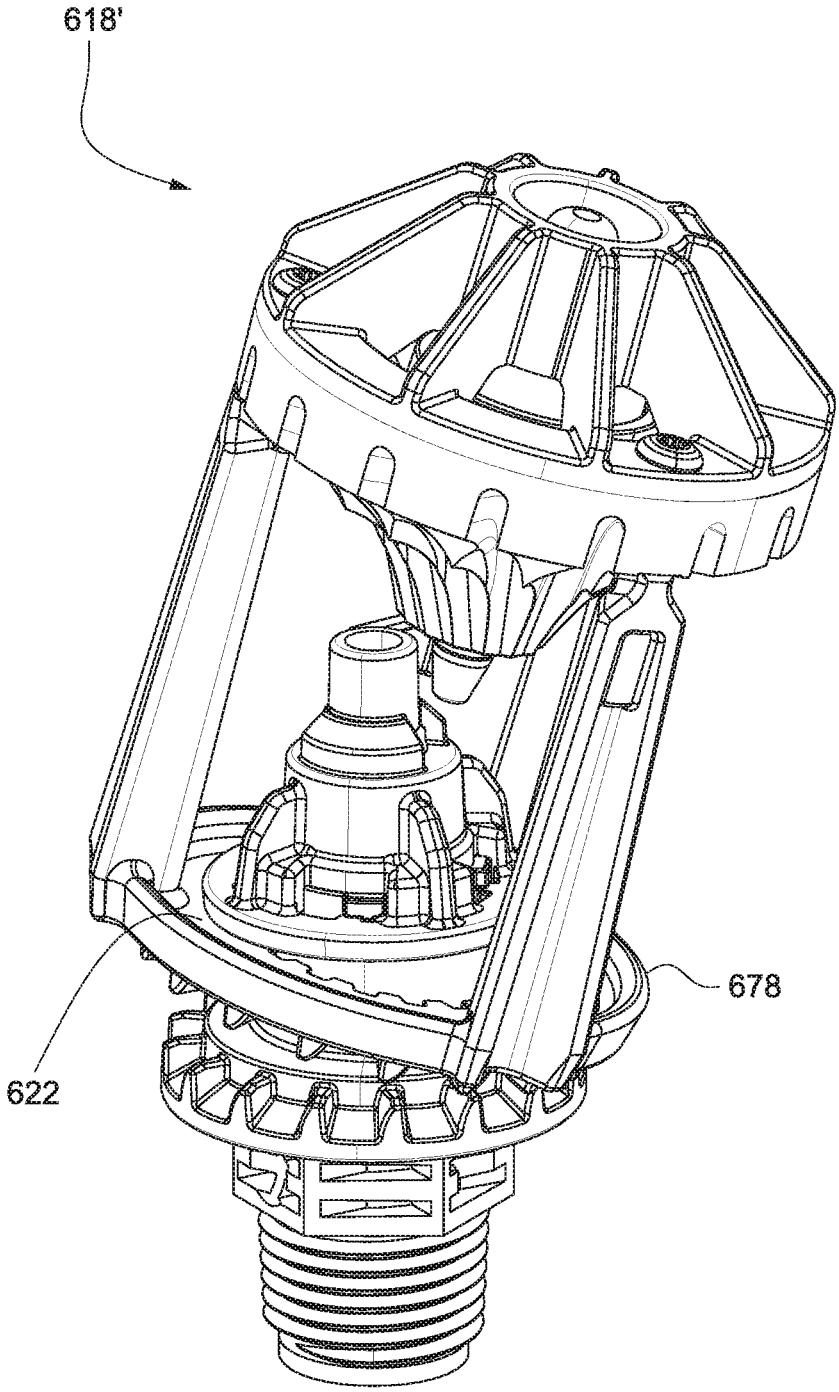
FIG. 59 shows a further variation with an upwardly protruding lip around the periphery of the wobbler cage.

FIG. 59 shows variation of the wobbler cage 618' with an upwardly protruding lip 678 around the periphery of the wobbler cage. In freezing conditions, this lip 678 tends to help prevent ice from building up around the perimeter of the wobbler ring 622 by pooling water within the lip 678.

The described embodiments provide for braking of the orbital action of a wobbler cage without using large fixed strut framework. The resulting structure reduces costs and sprinkler head size while also eliminating the dry shadows in the water pattern created by the fixed strut portions of prior designs. Eliminating the struts also prevents stringy material such as moss or food processing waste in the water to hairpin and build up on the struts. Still further, water patterns can be readily selected by positioning and/or removing teeth from the fixed gear or otherwise switching out the fixed gear to one suited for the desired water pattern. The action of the plate grooves moving in and out of the nozzle stream creates emerging/receding streams that fill in the water pattern for good distribution uniformity without an external diffuser.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A sprinkler head comprising:

a sprinkler body including a spool section with facing spool flanges on opposite sides of a spool core, at least one of the spool flanges including a circumferential rolling ledge;

a nozzle positioned within the sprinkler body through which water flows in a water flow direction;

a wobbler cage including a wobbler ring supported on the spool section;

a water deflector plate coupled with the wobbler cage and disposed downstream of the nozzle;

a brake assembly coupled with the water deflector plate for slowing a rotating and wobbling motion of the wobbler cage and the water deflector plate, the brake assembly including a shaft extending through the water deflector plate and a yoke arm disposed at an end of the shaft, wherein the yoke arm is engageable with the sprinkler body, wherein an underside of the wobbler ring comprises a circumferential rolling surface engaging the circumferential rolling ledge of the at least one spool flange; and spool teeth positioned on an outside circumference of the one of the spool flanges including the circumferential rolling ledge, wherein the underside of the wobbler ring comprises wobbler teeth positioned radially outward of the circumferential rolling surface, the wobbler teeth being positionable in spaces defined between the spool teeth, and wherein leading edges of the spool teeth are aligned with the water flow direction while trailing edges of the spool teeth are angled relative to the water flow direction.

2. A sprinkler head according to claim 1, wherein the spool teeth extend radially from the outside circumference of the one of the spool flanges including the circumferential rolling ledge.

3. A sprinkler head according to claim 1, wherein the spool teeth extend axially from the one of the spool flanges including the circumferential rolling ledge.

4. A sprinkler head according to claim 3, wherein the spool teeth comprise a beveled edge.

5. A sprinkler head according to claim 1, wherein the wobbler ring comprises an upwardly protruding lip around a perimeter of the wobbler ring.

6. A sprinkler head comprising:

a sprinkler body including a spool section with a top spool flange facing a bottom spool flange on opposite sides of a spool core, the bottom spool flange including a circumferential rolling ledge, wherein water flows through the sprinkler body in a water flow direction;

a wobbler cage including a wobbler ring supported on the spool section;

a water deflector plate coupled with the wobbler cage;

a brake assembly cooperable with the wobbler cage for slowing a rotating and wobbling motion of the wobbler cage and the water deflector plate, wherein an underside of the wobbler ring comprises a circumferential rolling surface engaging the circumferential rolling ledge of the bottom spool flange; and spool teeth positioned on an outside circumference of the one of the spool flanges including the circumferential rolling ledge, wherein the underside of the wobbler ring comprises wobbler teeth positioned radially outward of the circumferential rolling surface, the wobbler teeth being positionable in spaces defined between the spool teeth, and wherein leading edges of the spool teeth are aligned with the water flow direction while trailing edges of the spool teeth are angled relative to the water flow direction.

7. A sprinkler head according to claim 6, further comprising a nozzle positioned within the sprinkler body, wherein the water deflector plate is positioned downstream of the nozzle.

8. A sprinkler head according to claim 6, wherein the brake assembly is coupled with the water deflector plate and comprises a shaft extending through the water deflector plate and a yoke arm disposed at an end of the shaft, wherein the yoke arm is engageable with the sprinkler body.

9. A sprinkler head according to claim 6, wherein the spool teeth extend radially from the outside circumference of the bottom spool flange.

10. A sprinkler head according to claim 6, wherein the spool teeth extend axially from the bottom spool flange.

11. A sprinkler head according to claim 10, wherein the spool teeth comprise a beveled edge.

* * * * *